US010539909B2

(12) United States Patent
Sasaki et al.

(10) Patent No.: US 10,539,909 B2
(45) Date of Patent: Jan. 21, 2020

(54) ENDLESS BELT, IMAGE FORMING APPARATUS, AND ENDLESS BELT UNIT

(71) Applicant: FUJI XEROX CO., LTD., Tokyo (JP)

(72) Inventors: Tomoya Sasaki, Kanagawa (JP); Tsuyoshi Miyamoto, Kanagawa (JP); Kana Miyazaki, Kanagawa (JP); Wataru Yamada, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 443 days.

(21) Appl. No.: 15/356,255

(22) Filed: Nov. 18, 2016

(65) Prior Publication Data

US 2017/0363992 A1 Dec. 21, 2017

(30) Foreign Application Priority Data

Jun. 15, 2016 (JP) ..... 2016-119133

(51) Int. Cl.
*G03G 15/16* (2006.01)
*G03G 15/20* (2006.01)

(52) U.S. Cl.
CPC ..... *G03G 15/162* (2013.01); *G03G 15/2057* (2013.01); *G03G 2215/1623* (2013.01)

(58) Field of Classification Search
None
See application file for complete search history.

(56) References Cited

U.S. PATENT DOCUMENTS

| | | | | |
|---|---|---|---|---|
| 9,857,735 | B1 * | 1/2018 | Yamada | G03G 15/162 |
| 2013/0327982 | A1 * | 12/2013 | Nakayama | C08G 73/1042 252/182.28 |
| 2014/0248070 | A1 | 9/2014 | Kubo et al. | |

FOREIGN PATENT DOCUMENTS

| | | | |
|---|---|---|---|
| JP | S62-206567 | A | 9/1987 |
| JP | 2000313071 | A * | 11/2000 |
| JP | 4042882 | B2 | 2/2008 |
| JP | 2008083337 | A * | 4/2008 |
| JP | 2010085450 | A * | 4/2010 |
| JP | 4877772 | B2 | 2/2012 |
| JP | 5062802 | B2 | 10/2012 |
| JP | 2014-170048 | A | 9/2014 |

OTHER PUBLICATIONS

JP 2010085450 A machine translation (2010).*

* cited by examiner

*Primary Examiner* — Ana L. Woodward
(74) *Attorney, Agent, or Firm* — Oliff PLC

(57) ABSTRACT

An endless belt includes a polyamide imide resin layer in which a content of at least one solvent selected from a solvent group A consisting of a urea solvent, an alkoxy group-containing amide solvent, and an ester group-containing amide solvent is from 0.005 parts by weight to 3 parts by weight with respect to 100 parts by weight of the polyamide imide resin layer.

20 Claims, 3 Drawing Sheets

ENDLESS BELT, IMAGE FORMING APPARATUS, AND ENDLESS BELT UNIT

CROSS-REFERENCE TO RELATED APPLICATIONS

This application is based on and claims priority under 35 USC 119 from Japanese Patent Application No. 2016-119133 filed Jun. 15, 2016.

BACKGROUND

1. Technical Field

The present invention relates to an endless belt, an image forming apparatus, and an endless belt unit.

2. Related Art

An electrophotographic image forming apparatus forms a charge on an image holding member such as a photoreceptor, forms an electrostatic charge image using laser light obtained by modulating an image signal or the like, and then develops the electrostatic charge image with a charged toner to form a visualized toner image. Then, the toner image is electrostatically transferred to a transfer member such as a recording sheet directly or via an intermediate transfer member to form a desired image.

SUMMARY

According to an aspect of the invention, there is provided an endless belt including:

a polyamide imide resin layer in which a content of at least one solvent selected from a solvent group A consisting of a urea solvent, an alkoxy group-containing amide solvent, and an ester group-containing amide solvent is from 0.005 parts by weight to 3 parts by weight with respect to 100 parts by weight of the polyamide imide resin layer.

BRIEF DESCRIPTION OF THE DRAWINGS

Exemplary embodiments of the present invention will be described in detail based on the following figures, wherein.

DETAILED DESCRIPTION

Figure 1A:
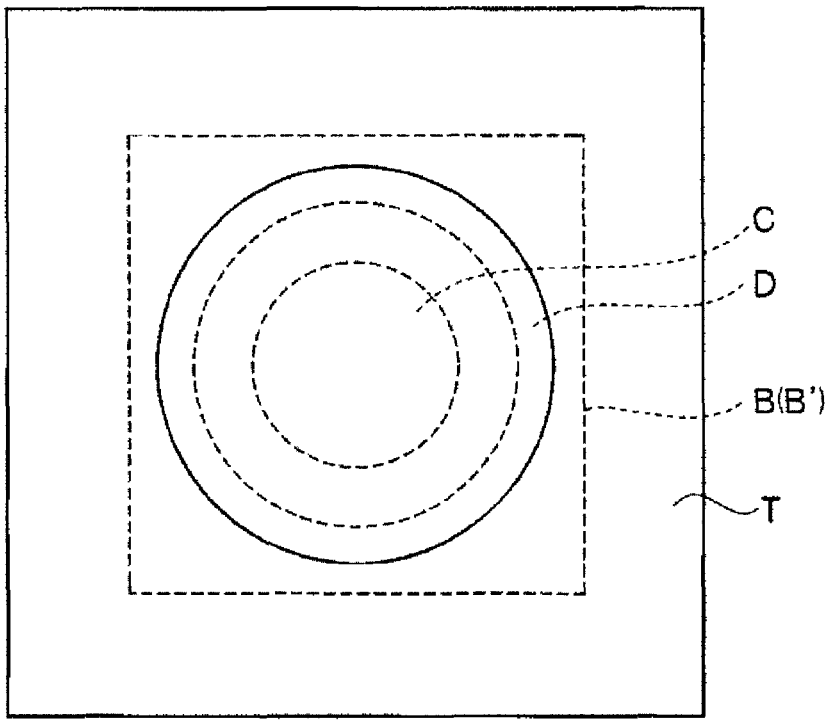
FIGS. 1A and 1B are a schematic plan view and a schematic cross-sectional view showing an example of a circular electrode.

Hereinafter, exemplary embodiments which are examples of the invention will be described in detail.

Endless Belt

An endless belt according to an exemplary embodiment has a polyamide imide resin layer containing at least one solvent selected from a solvent group A consisting of a urea solvent, an alkoxy group-containing amide solvent, and an ester group-containing amide solvent. The content of the solvent of the solvent group A is from 0.005 parts by weight to 3 parts by weight with respect to 100 parts by weight of the entirety of the polyamide imide resin layer.

In an electrophotographic image forming apparatus, for example, an endless belt using a polyimide resin is used. There is a case in which the endless belt using a polyimide resin is applied to, for example, an intermediate transfer belt. Typically, the polyimide resin is dissolved in a solvent in a state of a polyamic acid, applied to a substrate, and imidized by heating in many cases. The imidization by heating is carried out at a heating temperature of, for example, 300° C. or higher, thereby causing deterioration in productivity.

On the other hand, since a polyamide imide resin is soluble in a solvent and has excellent workability, an endless belt that may be applied to an intermediate transfer belt or the like may be obtained at a lower cost compared with a case of using a polyimide resin. As the endless belt using a polyamide imide resin, for example, an endless belt having a polyamide imide resin layer in which the amount of a residual solvent is adjusted is proposed.

The endless belt used in an image forming apparatus may be used as, for example, in addition to an intermediate transfer belt of a transfer device (an example of a transfer unit), a transfer belt, or a transport belt of a device of transporting a recording medium such as paper (an example of a recording medium).

The endless belt (intermediate transfer belt, transfer belt, or transport belt) of the transfer device and the recording medium transport device is stretched in a state in which tension is applied by, for example, plural rolls. In the area in which the endless belt is stretched in a state in which tension is applied by plural rolls, the endless belt is in a state in which a load is applied. When the endless belt is stored in a state in which a load is applied, in the portion of the endless belt to which a load is applied, a change in shape is remarkable, the changed shape thereof does not return to a shape in an allowable range, and the remarkably changed shape is maintained in some cases. In recent years, as an image forming apparatus has been miniaturized, the diameter of the roll over which the endless belt is stretched has been decreased and the number of rolls has been also decreased. Therefore, in the area in which the endless belt is stretched in a state in which tension is applied by the rolls, the endless belt has a large curvature and a load larger than in the related art is applied. Thus, the above-mentioned phenomenon more remarkably occurs.

In contrast, due to the above configuration of the endless belt according to the exemplary embodiment, even in the case in which the endless belt is stored in a state in which a load is applied, a change in shape is prevented in the portion of the endless belt to which a load is applied. Although the reason is not clear, it is assumed as follows.

Regarding the polyamide imide resin, in the process of obtaining a resin film (molded article) of the polyamide imide resin, a solvent in which the polyamide imide resin is dissolved is volatilized. Then, in the obtained polyamide imide resin, the interaction between the polar group of the solvent of the solvent group A included in the polyamide imide resin and the polar group of the polyamide imide resin occurs.

Here, it is considered that the interaction between the polar group of the solvent of the solvent group A and the polar group of the polyamide imide resin is stronger than the interaction between polar groups of a solvent and a polyamide imide resin in the case in which a polyamide imide resin does not include the solvent of the solvent group A and includes only a solvent used in the related art (such as N-methylpyrrolidone, N,N-dimethylacetamide, or γ-butyrolactone). Particularly, in the case in which only γ-butyrolactone is contained in the polyamide imide resin as a solvent, the interaction between the polar group of γ-butyrolactone and the polar group of the polyamide imide resin is weak and also ring opening decomposition of γ-butyrolactone easily occurs. Thus, it is difficult to continue a stable interaction.

As described above, since the polyamide imide resin that contains the solvent of the solvent group A in an amount within the above range has a stronger interaction with the polar group of the solvent than the interaction between polar groups of a solvent used in the related art and a polyamide imide resin, it may be considered that the polyamide imide resin that contains the solvent of the solvent group A has remarkably increased flexibility compared with a polyamide imide resin that contains only a solvent used in the related art.

In addition, it is considered that in the polyamide imide resin, due to the interaction between the polar group of the solvent of the solvent group A and the polar group of the polyamide imide resin, the molecular chain of the polyamide imide resin and the molecules of the solvent of the solvent group A included in the polyamide imide resin form a stacking (laminated) structure. In the case in which the amount of the solvent of the solvent group A contained in the polyamide imide resin is too small, the interaction between the polar group of the solvent of the solvent group A and the polar group of the polyamide imide resin is weak. On the other hand, in the case in which the content of the solvent of the solvent group A is too large, a distance between the molecular chains of the polyamide imide resin increases.

Therefore, it is considered that since the polyamide imide resin contains the solvent of the solvent group A in an amount within the above range, a stable stacking structure is formed. Thus, the solvent of the solvent group A contained in the polyamide imide resin is not easily volatized during storage.

As described above, since the polyamide imide resin layer constituting the endless belt according to the exemplary embodiment contains the solvent of the solvent group A in an amount within the above range, the interaction between the polar group of the solvent of the solvent group A and the polar group of the polyamide imide resin is stronger that the interaction between the polar groups of the polyamide imide resin and the solvent used in the related art. It is considered that due to this interaction, even in the case in which the endless belt is stored in a state in which the load is applied, a change in shape is prevented in the portion of the endless belt to which a load is applied.

The polar group of the solvent of the solvent group A corresponds to a urea group in the case of using a urea solvent, an alkoxy group and an amide group in the case of using an alkoxy group-containing amide solvent, and an ester group and an amide group in the case of using an ester group-containing amide solvent. In addition, the polar group of the polyamide imide resin corresponds to an amide group or an imide group.

From the above, due to the above configuration of the endless belt according to the exemplary embodiment, even in the case in which the endless belt is stored in a state in which a load is applied, a change in shape is prevented in the portion of the endless belt to which a load is applied.

Since the polyamide imide resin layer constituting the endless belt according to the exemplary embodiment contains the solvent of the solvent group A in an amount within the above range, the endless belt has the following advantages.

Due to a strong interaction between the polar group of the solvent of the solvent group A and the polar group of the polyamide imide resin, in the case of repeatedly forming an image, a reduction in the content of the solvent of the solvent group A is prevented. Therefore, in the endless belt according to the exemplary embodiment, even in the case of repeatedly forming an image, damage phenomena such as cracking, defects, and deflection of the endless belt may be prevented from occurring compared with the case of an endless belt having a polyamide imide resin layer containing only a solvent used in the related art.

The solvent of the solvent group A has a high polarity similar to N-methylpyrrolidone and has hygroscopicity. However, it is considered that in the endless belt according to the exemplary embodiment, due to the strong interaction between the polar group of the solvent of the solvent group A and the group of the polyamide imide resin, the polar groups of both the solvent and the polyamide imide resin are blocked and thus the hygroscopicity is prevented. The reason is that in the endless belt according to the exemplary embodiment, the electrical resistance value in the case of repeatedly forming an image is prevented from lowering and stability in electric characteristics with respect to changes in environment of temperature and humidity is improved compared with the case of an endless belt having a polyamide imide resin layer containing only a solvent used in the related art.

As another factor of lowering of the electrical resistance value in the case of repeatedly forming an image, the insulation breakdown of the polyamide imide resin by voltage application may be considered. In the endless belt according to the exemplary embodiment, it is considered that due to the strong interaction between the polar group of the solvent of the solvent group A and the polar group of the polyamide imide resin, the above stable stacking structure is formed. Thus, the endless belt according to the exemplary embodiment also has improved insulation breakdown resistance compared with the case of an endless belt having a polyamide imide resin layer containing only a solvent used in the related art.

Polyamide Imide Resin

Hereinafter, the polyamide imide resin for obtaining the polyamide imide resin layer constituting the endless belt according to the exemplary embodiment will be described.

First, the raw material obtaining the polyamide imide resin layer constituting the endless belt will be described.

As the raw material obtaining the polyamide imide resin, generally, a trivalent carboxylic acid component (tricarboxylic acid component) having an acid anhydride group, and isocyanate or diisocyanate may be used. As the trivalent carboxylic acid component, from the viewpoint of bendability, storage stability, and costs, a trimellitic acid anhydride is preferable. In addition, the trimellitic acid anhydride and a derivative of a trivalent carboxylic acid having an acid anhydride group reacting with other isocyanate groups or amino groups may be used in combination. As a preferable structure, a structure represented by the following formula (1) may be exemplified.

(1)

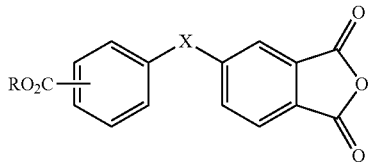

In the formula (1), R represents a hydrogen atom, an alkyl group having 1 to 10 carbon atoms, or a phenyl group, and X represents —$CH_2$—, —CO—, —$SO_2$—, or —O—.

In addition to these compounds, if required, tetracarboxylic acid dianhydrides (such as pyromellitic dianhydride, 3,3',4,4'-benzophenonetetracarboxylic acid dianhydride, 3,3',4,4'-biphenyltetracarboxylic acid dianhydride, 1,2,5,6-naphthalenetetracarboxylic acid dianhydride, 2,3,5,6-pyridinetetracarboxylic acid dianhydride, 1,4,5,8-naphthalenetetracarboxylic acid dianhydride, 3,4,9,10-perylenetetracarboxylic acid dianhydride, 4,4'-sulfonyldiphthalic acid dianhydride, m-terphenyl-3,3',4,4'-tetracarboxylic acid dianhydride, 4,4'-oxydiphthalic acid dianhydride, 1,1,1,3,3,3-hexafluoro-2,2-bis(2,3- or 3,4-dicarboxyphenyl) propane dianhydride, 2,2-bis(2,3- or 3,4-dicarboxyphenyl) propane dianhydride, 2,2-bis[4-(2,3- or 3,4-dicarboxyphenoxy)phenyl]propane dianhydride, 1,1,1,3,3,3-hexafluoro-2,2-bis[4-(2,3- or 3,4-dicarboxyphenoxy)phenyl]propane dianhydride, 1,3-bis(3,4-dicarboxyphenyl)-1,1,3,3-tetramethyldisiloxane dianhydride, butanetetracarboxylic acid dianhydride, and bicyclo-[2,2,2]-octo-7-ene-2,3,5,6-tetracarboxylic acid dianhydride), aliphatic dicarboxylic acids (such as succinic acid, glutaric acid, adipic acid, azelaic acid, sebacic acid, sebacic acid, decanedioic acid, dodecanedioic acid, and dimer acid), aromatic dicarboxylic acids (such as isophthalic acid, terephthalic acid, phthalic acid, naphthalene dicarboxylic acid, and oxydibenzoic acid), and the like may be used in combination.

As isocyanates, 3,3'-dimethylbiphenyl-4,4'-diisocyanate, 2,2'-dimethylbiphenyl-4,4'-diisocyanate, biphenyl-4,4'-diisocyanate, biphenyl-3,3'-diisocyanate, biphenyl-3,4'-diisocyanate, 3,3'-diethyl biphenyl-4,4'-diisocyanate, 2,2'-diethyl biphenyl-4,4'-diisocyanate, 3,3'-dimethoxy biphenyl-4,4'-diisocyanate, 2,2'-dimethoxy biphenyl-4,4'-diisocyanate, naphthalene-1,5-diisocyanate, naphthalene-2,6-diisocyanate, and the like may be used. In addition, as diamines, compounds having the same structure as the isocyanates in which an amino group is substituted instead of an isocyanate group may be used.

The use of these plural isocyanates in combination is suitable from the viewpoint of reducing unevenness in density during printing.

As a solvent to be used when the polyamide imide resin is formed using the above raw material (a polymerization reaction is carried out), a solvent including the solvent of the solvent group A may be used. Examples of the solvent including the solvent of the solvent group A include a solvent including only the solvent of the solvent group A, and a solvent including the solvent of the solvent group A and an organic solvent other than the solvent of the solvent group A.

In the case of using an organic solvent other than the solvent of the solvent group A, a ratio between the solvent of the solvent group A and the organic solvent other than the solvent of the solvent group A is not limited but the ratio of the solvent of the solvent group A may be 30% by weight or more (preferably 40% by weight or more, more preferably 50% by weight or more). By controlling the ratio of the solvent of the solvent group A to be within the above range, the content of the solvent of the solvent group A included in the polyamide imide resin layer is easily controlled to be within a range of 0.005 parts by weight to 3 parts by weight with respect to 100 parts by weight of the polyamide imide resin layer.

The details of the solvent of the solvent group A and the organic solvent other than the solvent of the solvent group A will be described later.

A blending ratio between the isocyanate or diisocyanate and the tricarboxylic acid component may be, for example, from 0.6 to 1.4, (preferably from 0.7 to 1.3, more preferably from 0.8 to 1.2) as a total number ratio of isocyanate or diisocyanate with respect to the total number of the carboxyl groups and acid anhydride groups of the acid component.

As the method of forming the polyamide imide resin, for example, the following preparation methods may be used.

(1) A method in which in the case of using isocyanate, an isocyanate component and a tricarboxylic acid component are used at a time and allowed to react to obtain a polyamide imide resin.

(2) A method in which an excessive amount of isocyanate and an acid component are allowed to react to synthesize an amide imide oligomer having an isocyanate group at the terminal thereof and then a tricarboxylic acid component is added to conduct a reaction so as to obtain a polyamide imide resin.

(3) A method in which an excessive amount of a tricarboxylic acid component and an isocyanate component are allowed to react to synthesize an amide imide oligomer having a carboxylic acid or an acid anhydride group at the terminal thereof and then the acid component is allowed to react with an isocyanate component by adding the isocyanate component to obtain a polyamide imide resin.

In the case of using amide, a polyamide imide resin may be obtained in the same preparation method as in the case of using isocyanate shown above and may also obtained by allowing other amines and tribasic acid anhydride monochloride as an acid component to react at a low temperature for several hours.

The number average molecular weight of the polyamide imide resin obtained as described above is preferably from 10,000 to 45,000. When the number average molecular weight is 10,000 or more, film formability is good and bending resistance is improved. In addition, when the number average molecular weight is 45,000 or less, dispersibility of conductive particles, moldability as an endless belt, thickness precision, and the like are improved.

The number average molecular weight of the polyamide imide resin is measured by gel permeation chromatography (GPC) using a standard polyethylene calibration curve by carrying out sampling during resin synthesis, and the synthesis is continued until a desired number average molecular weight is obtained. Thus, the number average molecular weight is controlled to be within the above range.

Solvent Group A

Next, the solvent group A of the solvent contained in the polyamide imide resin layer constituting the endless belt will be described. The solvent group A is a solvent group consisting of a urea solvent, an alkoxy group-containing amide solvent, and an ester group-containing amide solvent.

In the endless belt according to the exemplary embodiment, the amount of the solvent of the solvent group A included in the polyamide imide resin layer constituting the endless belt is from 0.005 parts by weight to 3 parts by weight with respect to 100 parts by weight of the entirety of the polyamide imide resin layer. Even in the case in which the endless belt is stored in a state in which a load is applied, a change in shape is prevented in the portion of the endless belt to which a load is applied. From the viewpoint of further exhibiting the above advantage and the like, the content of the solvent of the solvent group A is preferably from 0.05 parts by weight to 2 parts by weight and more preferably from 0.1 parts by weight to 1 part by weight.

The content of at least one solvent selected from the solvent group A refers to the total amount of solvents of the solvent group A.

Here, the content of the solvent of the solvent group A contained in the polyamide imide resin layer constituting the endless belt according to the exemplary embodiment to be within the above range, may be adjusted by, for example, adjusting heating conditions (heating temperature and haring time) for a dried film obtained by drying a coating film of a polyamide imide resin composition in the method of preparing the endless belt which will be described later.

The solvent (residual solvent) contained in the polyamide imide resin layer constituting the endless belt may be measured with a gas chromatography mass spectrometer (GC-MS) and the like by collecting a sample for measurement from the polyamide imide resin layer of the endless belt to be measured. Specifically, 0.40 mg of a sample for measurement from the polyamide imide resin layer of the endless belt to be measured is precisely weighed, and a gas chromatography mass spectrophotometer (GCMS QP-2010, manufactured by Shimadzu Corporation) in which a falling type pyrolysis device (PY-2020D, manufactured by Frontier Laboratories Ltd.) is installed is used for the measurement under the following conditions.

Thermal decomposition temperature: 400° C.

Gas chromatography introduction temperature: 280° C.

Inject method: split ratio: 1:50

Column: Ultra ALLOY-5, 0.25 μm, 0.25 μm ID, 30 m: manufactured by Frontier Laboratories Ltd.

Gas chromatography temperature program: 40° C.=>20° C./min=>280° C.—holding for 10 min Mass range: EI, m/z=29-600

Hereinafter, the solvent of the solvent group A will be described later in detail.

Urea Solvent

The urea solvent is a solvent having a urea group (N—C(=O)—N). Specifically, the urea solvent may be a solvent having a "*—N($Ra^1$)—C(=O)—N($Ra^2$)—*" structure. Here, $Ra^1$ and $Ra^2$ each independently represent a hydrogen atom, an alkyl group, a phenyl group, or a phenyl alkyl group. Both terminals* of two N atoms are bonding portions with a group of other atoms having the above structure. The urea solvent may be a solvent having a ring structure in which both terminals* of two N atoms are linked via, for example, alkylene, —O—, —C(=O)—, or a linking group of a combination thereof.

The alkyl group represented by $Ra^1$ and $Ra^2$ may be chained, branched, or cyclic, and may have a substituent. Specific example of the alkyl group include alkyl groups having 1 to 6 carbon atoms (preferably 1 to 4 carbon atoms) (for example, a methyl group, an ethyl group, a n-propyl group, an i-propyl group, and a n-butylkgroup).

Examples of the substituent of the alkyl group include an alkoxy group having 1 to 4 carbon atoms, a hydroxyl group, a ketone group, an ester group, and an alkyl carbonyloxy group.

Specific examples of the ketone group include a methyl carbonyl group (acetyl group), an ethyl carbonyl group, and a n-propyl carbonyl group. Specific examples of the ester group include a methoxy carbonyl group, an ethoxy carbonyl group, a n-propoxy carbonyl group, and an acetoxy group. Specific examples of the alkyl carbonyloxy group include a methyl carbonyloxy group (acetyloxy group), an ethyl carbonyloxy group, and a n-propyl carbonyloxy group.

The phenyl skeleton of the phenyl group or the phenyl alkyl group represented by $Ra^1$ and $Ra^2$ may have a substituent. The substituent in the phenyl skeleton includes the same substituents of the above alkyl group.

In the case in which the urea solvent has the ring structure in which the both terminals* of the above two N atoms are linked, the number of ring members may be 5 or 6.

Examples of the urea solvent include 1,3-dimethyl urea, 1,3-diethyl urea, 1,3-diphenyl urea, 1,3-dicyclohexyl urea, tetramethyl urea, tetraethyl urea, 2-imidazolidinone, propylene urea, 1,3-dimethyl-2-imidazolidinone, and N,N-dimethyl propylene urea.

Among these, from the viewpoints of preventing cracking of the resin film (molded article) of the polyamide imide resin from occurring and improving storage stability at room temperature and in a refrigerated state, as the urea solvent, 1,3-dimethyl urea, 1,3-diethyl urea, tetramethyl urea, tetraethyl urea, 1,3-dimethyl-2-imidazolidinone, and N,N-dimethyl propylene urea are preferable, and tetramethyl urea, tetraethyl urea, 1,3-dimethyl-2-imidazolidinone, and N,N-dimethyl propylene urea are most preferable.

Alkoxy Group-Containing Amide Solvent and Ester Group-Containing Amide Solvent

The alkoxy group-containing amide solvent is a solvent having an alkoxy group and an amide group. On the other hand, the ester group-containing amide solvent is a solvent having an ester group and an amide group. As the alkoxy group and the ester group, the same groups as the alkoxy groups and the ester groups exemplified as the "substituent of the alkyl group represented by $Ra^1$ and $Ra^2$" in the description of the urea solvent may be used. The alkoxy group-containing amide solvent may have an ester group and the ester group-containing amide solvent may have an alkoxy group.

Hereinafter, both the alkoxy group-containing amide solvent and the ester group-containing amide solvent will be referred to as an "alkoxy group- or ester group-containing amide solvent".

The alkoxy group- or ester group-containing amide solvent is not particularly limited and specifically, an amide solvent represented by the following formula (Am1), an amide solvent represented by the following formula (Am2), and the like may be suitably used.

(Am1)

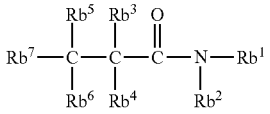

In the formula (Am1), $Rb^1$, $Rb^2$, $Rb^3$, $Rb^4$, $Rb^5$, and $Rb^6$ are each independently represent a hydrogen atom, or an alkyl group. $Rb^7$ represents an alkoxy group or an ester group.

The alkyl group represented by $Rb^1$ to $Rb^6$ is the same as the "alkyl group represented by $Ra^1$ and $Ra^2$" in the description of the urea solvent.

As the alkoxy group and the ester group represented by $Rb^7$, the same groups as the alkoxy groups and the ester groups exemplified as the "substituent of the alkyl group represented by $Ra^1$ and $Ra^2$" in the description of the urea solvent may be used.

Hereinafter, specific examples of the amide solvent represented by the formula (Am1) will be shown but the amide solvent is not limited thereto.

| Exemplified compound No. | $Rb^1$ | $Rb^2$ | $Rb^3$ | $Rb^4$ | $Rb^5$ | $Rb^6$ | $Rb^7$ |
|---|---|---|---|---|---|---|---|
| B-1 | Me | Me | H | H | H | H | —$CO_2Me$ |
| B-2 | Me | Me | H | H | H | H | —$CO_2Et$ |
| B-3 | Et | Et | H | H | H | H | —$CO_2Me$ |
| B-4 | Me | Me | H | H | H | H | —OMe |
| B-5 | Me | Me | H | H | H | H | —OEt |
| B-6 | Me | Me | H | H | H | H | —OnPr |
| B-7 | Me | Me | H | H | H | H | —OnBu |
| B-8 | Et | Et | H | H | H | H | —OMe |
| B-9 | Me | Me | H | H | H | H | —OC(═O)Me |
| B-10 | Me | Me | Me | H | H | H | —OMe |

In the specific examples of the amide solvent represented by the formula (Am1), Me represents a methyl group, Et represents an ethyl group, nPr represents a n-propyl group, and a nBu represents a n-butyl group.

(Am2)

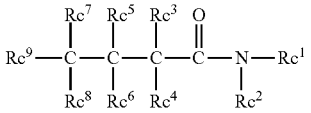

In the formula (Am2), $Rc^1$, $Rc^2$, $Rc^3$, $Rc^4$, $Rc^5$, $Rc^6$, $Rc^7$, and $Rc^8$ each independently represent a hydrogen atom or an alkyl group. $Rc^9$ represents an alkoxy group or an ester group.

The alkyl group represented by $Rc^1$ to $Rc^8$ is the same as the "alkyl group represented by $Ra^1$ and $Ra^2$" in the description of the urea solvent.

As the alkoxy group and the ester group represented by $Rc^9$, the same groups as the alkoxy groups and the ester groups exemplified as the "substituent of the alkyl group represented by $Ra^1$ and $Ra^2$" in the description of the urea solvent may be used.

Hereinafter, specific examples of the amide solvent represented by the formula (Am2) will be shown but the amide solvent is not limited thereto.

| Exemplified compound No. | $Rc^1$ | $Rc^2$ | $Rc^3$ | $Rc^4$ | $Rc^5$ | $Rc^6$ | $Rc^7$ | $Rc^8$ | $Rc^9$ |
|---|---|---|---|---|---|---|---|---|---|
| C-1 | Me | Me | H | H | H | H | H | H | —$CO_2Me$ |
| C-2 | Me | Me | Me | H | H | H | H | H | —$CO_2Me$ |
| C-3 | Me | Me | H | H | H | H | Me | H | —$CO_2Me$ |
| C-4 | Et | Et | H | H | H | H | H | H | —OMe |
| C-5 | Me | Me | H | H | Me | H | H | H | —$CO_2Me$ |
| C-6 | Me | Me | H | H | H | H | H | H | —$CO_2Et$ |
| C-7 | Me | Me | H | H | H | H | Me | H | —$CO_2Et$ |
| C-8 | Me | Me | H | H | H | H | H | H | —OC(═O)Me |
| C-9 | Me | Me | H | H | H | H | H | H | —OEt |
| C-10 | Me | Me | H | H | H | H | H | H | —OnPr |

In the specific examples of the amide solvent represented by the formula (Am2), Me represents a methyl group, Et represents an ethyl group, and nPr represents a n-propyl group.

Among these, from the viewpoint of further exhibiting an advantage in that even in the case in which the endless belt is stored in a state in which a load is applied, in the portion of the endless belt to which a load is applied, a change in shape is prevented, and the like, as the alkoxy group- or ester group-containing amide solvent, 3-methoxy-N,N-dimethylpropanamide (Exemplified compound B-4), 3-n-butoxy-N,N-dimethylpropanamide (Exemplified compound B-7), and 5-dimethylamino-2-methyl-5-oxo-pentane acid methyl (Exemplified compound C-3) are preferable, and 3-methoxy-N,N-dimethylpropanamide (Exemplified compound B-4) is more preferable.

From the viewpoint of further exhibiting an advantage in that even in the case in which the endless belt is stored in a state in which a load is applied, in the portion of the endless belt to which a load is applied, a change in shape is prevented, and the like, the solvent group A including organic solvents is preferably a solvent group consisting of tetramethyl urea, tetraethyl urea, 1,3-dimethyl-2-imidazolidinone, N,N-dimethylpropylene urea, and 3-methoxy-N,N-dimethylpropanamide. From the same viewpoint, the solvent group A including organic solvents more preferably includes 1,3-dimethyl-2-imidazolidinone.

Incidentally, 1,3-dimethyl-2-imidazolidinone has two nitrogen atoms of amino group in one molecule. Therefore, for example, compared with N-methylpyrrolidone which is used as a solvent used in the related art and has only one nitrogen atom of amino group in one molecule, the interaction between 1,3-dimethyl-2-imidazolidinone and the polyimide amide resin easily occurs. Further, since 1,3-dimethyl-2-imidazolidinone has a cyclic structure and a stable conformation, for example, compared with acyclic tetramethyl urea, the interaction between 1,3-dimethyl-2-imidazolidinone and the polyimide amide resin easily occurs, and thus it is assumed that 1,3-dimethyl-2-imidazolidinone is a more suitable solvent.

Boiling Point of Solvent of Solvent Group A

The boiling point of the solvent of the solvent group A (each solvent of the above specific solvent group A) is, for example, preferably from 100° C. to 350° C., more preferably from 120° C. to 300° C., and still more preferably from 150° C. to 250° C.

When the boiling point of the solvent of the solvent group A is 100° C. or higher, the amount of the solvent contained in the polyamide imide resin layer is prevented from reducing in use of the endless belt.

On the other hand, when the boiling point of the solvent of the solvent group A is 350° C. or lower (particularly 250° C. or lower), the amount of the solvent of the solvent group A contained in the polyamide imide resin layer after the endless belt is prepared is easily controlled to be within a range of 0.005 parts by weight to 3 parts by weight with respect to 100 parts by weight of the entirety of the polyamide imide resin layer.

Organic Solvents Other than Solvent Group A

The solvent may include organic solvents other than the solvent group A. The organic solvents other than the solvent group A are not particularly limited and known solvents (for example, non-proton type polar solvents other than the solvent of the solvent group A, ether solvents, ketone solvents, ester solvent, and hydrocarbon solvents) may be used.

Specifically, examples of the organic solvents other than the solvent group A include non-proton type polar solvents other than the solvent of the solvent group A such as N,N-dimethylformamide, N,N-dimethylacetamide, N,N-diethylformamide, N,N-diethylacetamide, N,N-dimethylmethoxyacetamide, dimethyl sulfoxide, hexamethylphosphorous triamide, N-methyl-2-pyrrolidone, N-ethyl-2-pyrrolidone, tetramethylene sulfone, dimethyl tetramethylene sulfone, γ-butyrolactone, dimethyl carbonate, diethyl carbonate, ethylene carbonate, and propylene carbonate; ketone solvents such as acetone, methyl isobutyl ketone, diacetone alcohol, cyclopentanone, and cyclohexanone; ester solvents such as ethyl acetate, isobutyl acetate, n-butyl acetate, n-pentyl acetate, and ethyl lactate; and hydrocarbon solvent such as hexane, benzene, and toluene.

Conductive Particles

The endless belt according to the exemplary embodiment may include conductive particles to be added to impart conductivity, if required. Examples of the conductive particles include conductive particles with conductivity (for example, volume resistivity is less than $10^7$ Ω·cm, the same will be applied), or semiconductivity (for example, volume resistivity is $10^7$ Ω·cm to $10^{13}$ Ω·cm, the same will be applied), and the conductive particles are selected according to the purpose of use.

The conductive particles are not particularly limited and examples thereof include metals, metal oxides, conductive polymers, and carbon black. These particles may be used alone or in combination of two or more thereof. In the case of using two or more conductive particles in combination, these particles may be simply mixed with each other or may be used in the form of a solid or fused body.

The average particle diameter of the conductive particles may be from 0.3 μm or less (preferably 0.1 μm or less). When the average particle diameter is excessively large, poor dispersion occurs and thus a defective image may be formed.

In addition, as the metals, aluminum, zinc, copper, chromium, nickel, silver, stainless steel, and the like, or deposits obtained by depositing these metals on the surface of plastic particles may be used.

Examples of the metal oxides include zinc oxide, titanium oxide, tin oxide, antimony oxide, indium oxide, bismuth oxide, tin-doped indium oxide, antimony- or tantalum-doped tin oxide, and antimony-doped zirconium oxide. Further, examples of the conductive polymers include polyaniline, and polythiophene.

Among these, for the reasons that excellent dispersibility in the polyamide imide resin and stabler storage stability (for example, a stable dispersion state is maintained even after being kept for 3 days or longer) are obtained and unevenness in electrical resistance to be imparted is prevented, carbon black is preferably used.

As the carbon black, commercially available products may be used. Specifically, for example, as furnace black, "Special Black 550", "Special Black 350", "Special Black 250", "Special Black 100", "Printex 35", and "Printex 25", all of which are manufactured by Orion Engineered Carbons; "MA7", "MA77", "MA8", "MA11", "MA100", "MA100R", "MA220", and "MA230", all of which are manufactured by Mitsubishi Chemical Corporation; and "MONARCH 1300", "MONARCH 1100", "MONARCH 1000", "MONARCH 900", "MONARCH 880", "MONARCH 800", "MONARCH 700", "MOGULL", "REGAL 400R", and "VULCANXC-72R", all of which are manufactured by Cabot Corporation.

Further, as channel black, "Color Black FW 200", "Color Black FW2", "Color Black FW2V", "Color Black FW1", "Color Black FW18", "Special Black 6", "Color Black S170", "Color Black S160", "Special Black 5", "Special Black 4", "Special Black 4A", "Printex 150T", "Printex U", "Printex V", "Printex 140U", and "Printex 140V", all of which are manufactured by Orion Engineered Carbons. These carbon blacks may be used alone or in combination of two or more thereof.

As the carob black, from the viewpoint of reducing a difference in the common logarithm value of the surface resistivity of the endless belt according to the exemplary embodiment, oxidized carbon black is preferably used.

Here, the pH value of the oxidized carbon black is preferably pH 5.0 or less, more preferably pH 4.5 or less, and still more preferably pH 4.0 or less. The oxidized carbon black to have a value of pH 5.0 or less has an oxygen-containing functional group, such as a carboxyl group, a hydroxyl group, a quinine group, or a lactone group, on the surface thereof. Thus, good dispersibility in the resin and good dispersion stability are obtained, and the variation of resistance of a semiconductive belt may be reduced. Also, electric field dependency is reduced and electric field concentration by transfer voltage does not easily occur.

In the case of using two or more carbon blacks, it is preferable that the carbon blacks substantially have different conductivities from each other. Regarding such carbon blacks, for example, carbon blacks having different physical properties such as specific surface area by a BET method using a degree of oxidation treatment, a DBP oil absorption amount, and a nitrogen adsorption may be used. When the two or more conductive powders are used, the effect of improving mixability and dispersibility is easily obtained.

Here, in the case of adding two or more conductive powders having different conductivities, the surface resistivity may be adjusted such that for example, a conductive powder exhibiting a high conductivity is first added and then a conductive powder having a low conductivity is added.

In addition, the carbon black to be used may be purified. The purification is carried out by removing impurities which are mixed with the carbon black in the preparation process, for example, impurities such as excessive oxidizing agents, treating agents, and byproducts, and other inorganic impurities and organic impurities.

For example, the method of carrying out purification may adopt a method of removing impurities by each treatment such as a high temperature heating treatment at a temperature from 500° C. to 1,000° C. in an inert gas or in vacuum, a treatment using an organic solvent such as carbon disulfide or toluene, a mixing treatment such as mixing (stirring) of water slurry or mixing in an aqueous organic acid solution. As the heating treatment of the powder, from the viewpoints of handlability in the production process and great energy loss, a treatment using an organic solvent and a treatment using water as a main component are preferable. The purification method is particularly preferably a treatment using water as a main component. Water in the purification is used for particularly preventing impurities from mixing and thus for example, ion exchange water, ultrapure water, distilled water, and ultrafiltrate water are preferably used.

In the endless belt according to the exemplary embodiment, from the viewpoint of imparting semiconductivity to the polyamide imide resin, carbon black grafted with various polymers may be used. Carbon black is preferably a carbon black grafted with a copolymer that has a reactive group that may react with the functional group on the surface of the carbon black, and has a segment having good affinity with the surface of the carbon black, and other segments. In addition, from the viewpoint of uniformly mixing and dispersing carbon black, a carbon black grafted with a hydrophilic polymer is preferable. Examples of the hydrophilic polymer include poly(N-vinyl-2-pyrrolidone), poly(N,N'-diethylacrylamide), poly(N-vinyl formamide), poly(N-vinyl acetamide), poly(N-vinyl phthalamide), poly(N-vinyl succinic acid amide), poly(N-vinyl ureas), poly(N-vinyl piperidone), and poly(N-vinyl caprolactam), poly(N-vinyl oxazolidone). In addition, the carbon black may be a carbon black in which a segment having good affinity with the surface of the carbon black is interposed when the carbon black is grafted with a hydrophilic polymer (block copolymer or the like).

The content of the carbon black may be from 10% by weight to 30% by weight (preferably from 18% by weight to 30% by weight) with respect to the resin solid content. When the content is within the above range, a predetermined surface resistivity may be easily obtained and in-plane variation of the surface resistivity of the semiconductive belt may be prevented. Particularly, when the content of the carbon black is within a range of 18% by weight to 30% by weight, unevenness in in-plane surface resistivity and electrical field dependency may be further improved.

The endless belt according to the exemplary embodiment may include polymer dispersing agent, if required, from the viewpoint of improving the dispersibility of the conductive particles in the polyamide imide resin. As the polymer dispersing agent, from the viewpoint of more satisfactorily dispersing the conductive particles in the polyamide imide resin, a polymer dispersing agent having a nitrogen atom in the molecular structure thereof is suitably used. Specific examples of the polymer dispersing agent include poly(N-vinyl-2-pyrrolidone), poly(N,N'-diethyl acrylamide), poly (N-vinyl formamide), poly(N-vinyl acetamide), poly(N-vinyl phthalamide), poly(N-vinyl succinic acid amide), poly (N-vinyl urea), poly(N-vinyl piperidone), poly(N-vinyl caprolactam), and poly(N-vinyl oxazolidone), and among these, poly(N-vinyl-2-pyrrolidone), poly(N,N'-diethylacrylamide), poly(N-vinyl acetamide), and poly(N-vinyl piperidone) may be used. These polymer dispersing agents may be used alone or in combination of two or more thereof.

The amount of the polymer dispersing agent to be blended may be from 0.01 parts by weight to 3.0 parts by weight (preferably from 0.05 parts by weight to 2 parts by weight) with respect to 10 parts by weight of the conductive particles from the viewpoint of dispersibility of the conductive particles.

Examples of Use of Endless Belt

The endless belt according to the exemplary embodiment may be used as, for example, an endless belt for an electrophotographic image forming apparatus. Examples of the endless belt for an electrophotographic image forming apparatus include an intermediate transfer belt, a transfer belt, and a transport belt. The endless belt according to the exemplary embodiment may be also used as, for example, belt-shaped members such as a transport belt, a driving belt and a laminate belt, other than the endless belt for an image forming apparatus.

Method of Preparing Endless Belt

Next, the method of preparing the endless belt according to the exemplary embodiment will be described.

The method of preparing the endless belt includes, for example, a process of forming a coating film by applying a polyamide imide resin composition to a cylindrical substrate (metal mold), a process of forming a dried film by drying the coating film formed on the substrate, and a process of forming a resin film by heating the dried coating film, and a process of releasing the resin film formed on the substrate from the substrate.

First, a polyamide imide resin composition is prepared. As the polyamide imide resin composition, the polyamide imide resin is dissolved in the solvent including the above-mentioned solvent of the solvent group A to prepare a composition. As the polyamide imide resin, the above-mentioned various combinations may be used. In addition, the polyamide imide resin may be copolymerized during preparation of a coating liquid or in coating film formation by mixing a polyamide imide resin precursor formed by mixing acid and amine, acid and amine or isocyanate. In addition, two or more polyamide imide resins may be used as a mixture.

In the polyamide imide resin composition, according to purposes of use, the above-mentioned conductive particles such as carbon black may be dispersed. In addition, if required, the above-mentioned polymer dispersing agent may be used. As the method of dispersing the conductive particles in the polyamide imide resin composition, for example, generally used dispersion methods using a media mill for carrying out pulverization using collision force of media such as ceramic beads, and balls, and a wet jet mill for making articles to pass through orifices with a high pressure, applying high shearing force, and using the collision force at the time of collision using a homogenizer or the like may be used.

Next, the prepared polyamide imide resin composition is applied to the surface of the cylindrical substrate (inner surface or outer surface). As the cylindrical substrate, for example, a cylindrical metal substrate formed of aluminum or stainless steel is suitably used. Substrates formed of other materials such as resin, glass, and ceramic may be used instead of the metal substrate. Further, a glass coater, a ceramic coater, or the like may be provided on the surface of the substrate, and a releasing agent such as a silicone resin or a fluororesin may be sued to impart releasing properties.

Here, in order to accurately apply the polyamide imide resin composition, a process of defoaming the polyamide imide resin composition before application may be carried out. By defoaming the polyamide imide resin composition, bubbles at the time of application and defects of the coating film are prevented from being generated.

As the method of defoaming the polyamide imide resin composition, a pressure reduction method, a centrifugal separation method, and the like may be used. Defoaming under reduced pressure is suitable in terms of simplicity and remarkable defaming performance.

As the method of applying the polyamide imide resin composition to the surface of the cylindrical substrate, for example, a method of applying the polyamide imide resin composition to the outer circumferential surface of the cylindrical metal mold by moving the rotating cylindrical metal mold in the rotation axis direction while discharging the polyamide imide resin composition from nozzles, an immersion annular coating method of immersing the cylindrical metal mold in the polyamide imide resin composition and pulling up the metal mold from the polyamide imide resin composition, a method of allowing the polyamide imide resin composition to follow on the inner circumferential surface of the cylindrical metal mold in the axial direction, and the like may be used.

The polyamide imide resin composition is applied to the surface of the cylindrical substrate to form a coating film and then the formed coating film is dried.

The coating film of the polyamide imide resin composition formed on the surface of the cylindrical substrate is heated while rotating the coating film to volatilize the solvent. Then, the coating film is dried until the state in which the composition is not dripped without rotating the coating film so as to form a dried film. The content of the solvent in the dried film may be 50% by weight or less (preferably 30% by weight or less) with respect to the total weight of the dried film.

As for the drying conditions, for example, it is more preferable that the drying temperature is within a range of 50° C. to 180° C. (preferably from 60° C. to 150° C.) and the drying time is within a range of 15 minutes to 60 minutes (preferably from 20 minutes to 40 minutes).

The dried film is formed on the substrate and then the formed dried film is further heated at a high temperature.

By further heating the film at a high temperature, the solvent is further volatilized from the dried film of the polyamide imide resin and a resin film (molded article) including the polyamide imide resin is formed. Heating may be carried out under the heating condition, for example, at a temperature higher than the glass transition temperature (Tg) of the polyamide imide resin (preferably a temperature 10° C. to 50° C. higher than Tg). In addition, the heating time may be set to, for example, from 20 minutes to 120 minutes (preferably from 40 minutes to 90 minutes).

From the viewpoint of controlling the content of the solvent of the solvent group A to be within a range of 0.005 parts by weight to 3 parts by weight with respect to 100 parts by weight of the entirety of the polyamide imide resin layer, the heating temperature may be set to a temperature which is equal to or higher than the boiling point of the solvent of the solvent group A. The heating time may be set such that the content of the solvent of the solvent group A may be controlled to a desired content.

The obtained resin film including the polyamide imide resin is released by a known method such as a method of blowing air into a space between the cylindrical metal mold and the resin film to release the resin film.

Through the above processes, the endless belt according to the exemplary embodiment is obtained.

Next, suitable ranges and measurement methods of various physical properties in the case in which the endless belt according to the exemplary embodiment is applied to an intermediate transfer belt will be described.

Surface Resistivity

Generally, by using a belt-shaped intermediate transfer member having a large degree of design freedom, and arraigning a photoreceptor and a primary transfer roll in an offset position, the influence on the potential on the photoreceptor at primary transfer may be reduced. Particularly, in a high speed printing image forming apparatus, the voltage is applied during a short period of time and a belt resistance difference at rising is emphasized. Thus, unevenness in density in image quality may occur. Further, the electrical resistance in this case exhibits a relationship with the surface resistance.

The intermediate transfer belt may have an absolute value of 1.0 (Log Ω/square)) or less (preferably 0.7 (Log Ω/square)) or less, more preferably 0.05 (Log Ω/square)) or less) as a difference between a common logarithmic value of the surface resistivity when the belt surface resistivity rise is reduced, that is, at 10 sec after voltage application and a common logarithmic value of the surface resistivity at 30 msec after voltage application (hereinafter, sometimes referred to as a "common logarithmic value difference of surface resistivity"). By controlling the value to be within the above range, an intermediate transfer belt capable of preventing unevenness in density occurring in a high speed machine and coping with the print speed other than high speed printing, and having a wide range of application to apparatuses may be obtained.

In addition, the common logarithmic value difference of the surface resistivity may be controlled by the above-mentioned type of carbon black and carbon black dispersion methods.

The common logarithmic value of the surface resistivity of the intermediate transfer belt at 30 msec after voltage application may be from 9 (Log Ω/square) to 13 (Log Ω/square) (preferably from 10 (Log Ω/square)) to 12 (Log Ω/square)). When the common logarithmic value of the surface resistivity of the intermediate transfer belt at 30 msec after voltage application is greater than 13 (Log Ω/square), the intermediate transfer belt electrostatically adsorbs the recording medium at the time of secondary transfer and the recording medium may not be released in some cases. On the other hand, when the common logarithmic value of the surface resistivity of the intermediate transfer belt at 30 msec after voltage application is less than 9 (Log Ω/square), the toner image holding force that is primarily transferred to the intermediate transfer member is not sufficient and granularity in image quality or image defects are generated in some cases. In addition, the common logarithmic value of the surface resistivity at 30 msec after voltage application may be controlled by selecting the above-mentioned type of carbon black and the amount of carbon black to be added.

Figure 1B:
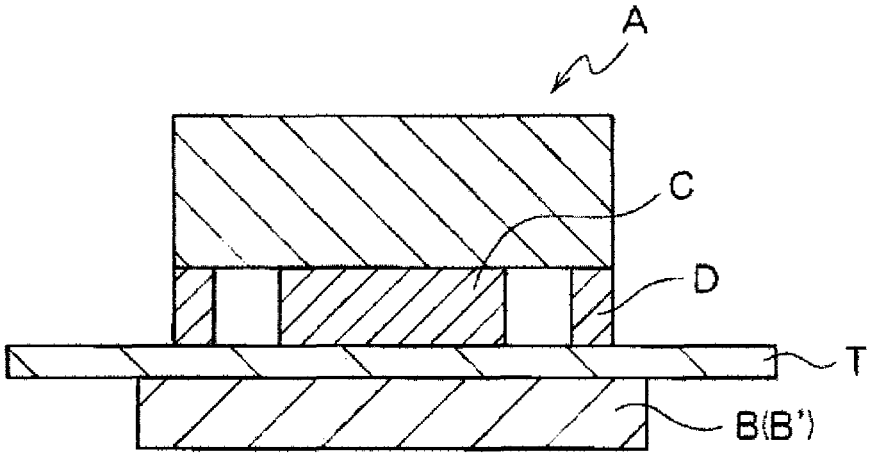

The surface resistivity may be measured using a circular electrode (for example, "UR PROBE" of HIGHRESTER IP, manufactured by Mitsubishi Chemical Co., Ltd.) according to JIS K6911 (1995). The method of measuring the surface resistivity will be described using drawings. FIGS. 1A and 1B are a schematic plan view and a schematic cross-sectional view showing an example of a circular electrode.

The circular electrode shown in FIGS. 1A and 1B includes a first voltage application electrode A and a plate-shaped insulator B. The first voltage application electrode A includes a cylindrical electrode portion C and a cylindrical ring-shaped electrode portion D having an inner diameter larger than the outer diameter of the cylindrical electrode portion C and surrounding the cylindrical electrode portion C with a constant interval. An object to be measured T is sandwiched between the cylindrical electrode portion C and the ring-shaped electrode portion D, and the plate-shaped insulator B of the first voltage application electrode A, and voltage V (V) is applied between the cylindrical electrode portion C and the ring-shaped electrode portion D of the first voltage application electrode A. A current I (A) flowing at this time is measured and the surface resistivity ρs (Ω/square) of the object to be measured T may be calculated by the following Equation (1). Here, in the following Equation (1), d (mm) represents the outer diameter of the cylindrical electrode portion C and D (mm) represents the inner diameter of the ring-shaped electrode portion D. In the exemplary embodiment, the current I (A) at 10 sec and 30 msec after the voltage V (V) is applied is measured.

$$\rho s=\pi\times(D+d)/(D-d)\times(V/I) \quad \text{Equation (1)}$$

More specifically, the measurement conditions of the surface resistivity are as follows.

Used electrode: circular electrode (UR PROBE of HIGHRESTER IP, manufactured by Mitsubishi Chemical Co., Ltd.: an outer diameter ϕ of a cylindrical electrode portion C: 16 mm, an inner diameter ϕ of a ring-shape electrode portion D: 30 mm, and an outer diameter ϕ: 40 mm)

Measurement environment: 22° C./55% RH

Voltage: 100 V

Volume Resistivity

The common logarithmic value of the volume resistivity of the intermediate transfer belt may be from 8 (Log Ωcm) to 13 (Log Ωcm). When the common logarithmic value of the volume resistivity is less than 8 (Log Ωcm), the electrostatic force of holding a charge of an infixed toner image that is transferred from the image holding member to an intermediate transfer belt becomes weak. Therefore, toner scatters to the surroundings of an image by an electrostatic repulsive force between toners and a fringe electric field force near an image edge, and thus an image is formed with a large amount of noise in some cases. On the other hand, when the common logarithmic value of the volume resistivity is greater than 13 (Log Ωcm), an charge holding force is great and thus the surface of the intermediate transfer belt is charged in the transfer electric field during primarily transfer in some cases.

The common logarithmic value of the volume resistivity may be controlled by the above-mentioned type of carbon black and amount of carbon black to be added.

In the exemplary embodiment, the volume resistivity may be measured using a circular electrode (for example, "UR PROBE" of HIGHRESTER IP, manufactured by Mitsubishi Chemical Co., Ltd.) according to JIS K6911 (1995). The measurement may be carried out with the same apparatus used in the measurement of the surface resistivity.

The circular electrode includes a first voltage application electrode A and a second voltage application electrode B' instead of the plate-shaped insulator B used at the time of the measurement of surface resistivity. The first voltage application electrode A includes a cylindrical electrode portion C. An object to be measured T is sandwiched between the cylindrical electrode portion C and the second voltage application electrode B' and voltage V (V) is applied between the cylindrical electrode portion C and the second voltage application electrode B' of the first voltage application electrode A. A current I (A) flowing at this time is measured, and the volume resistivity ρv (Ωcm) of the object to be measured T may be calculated by the following Equation (2). Here, in the following Equation (2), t represents the thickness of the object to be measured T.

$$\rho v=\pi d^2/4t\times(V/I) \quad \text{Equation (2)}$$

Young's Modulus

The Young's modulus of the intermediate transfer belt 16 is preferably 1,000 MPa or more and more preferably 1,500 MPa or more.

The Young's modulus E may be calculated based on the following Equation (3) by measuring a force ΔS applied to a unit cross-sectional area and elongation Δa of a unit length.

$$E=\Delta S/\Delta a \quad \text{Equation (3)}$$

Here, ΔS is represented by ΔS=F/(w×t) using a load F, a film thickness t of a sample, and a sample width w, Δa is represented by Δa=/ΔL/L using a reference length L of a sample, and sample elongation ΔL at the time of applying a load. For example, the measurement is carried out as follows.

First, the object to be measured T is cur into a size of 80 mm×5 mm. The Young's modulus thereof is measured 10 times to create average value measurement data. As the measuring device, a tensile tester MODEL-1605N, manufactured by Aikoh Engineering Co., Ltd. is used and the measurement condition is a tensile speed of 20 mm/min in an environment at 22° C. and 55% RH. Further, as the film thickness of the belt required for calculating the belt cross-sectional area, an average value obtained by five times measurement with an eddy current-format thickness meter CTR-1500E, manufactured by Sanko electronic laboratory Co., Ltd. is used.

Thickness

The total thickness of the intermediate transfer belt 16 may be from 0.05 mm to 0.5 mm (preferably from 0.06 mm to 0.30 mm, more preferably from 0.06 mm to 0.15 mm). When the total thickness of the belt is within a range of 0.05 mm to 0.5 mm, the mechanical strength of the intermediate transfer belt 16 is secured and cracking caused by stress concentration on the surface of the belt due to deformation in the roll bending portion may be prevented from occurring.

Surface Micro Hardness

Deformation of the transfer surface of the intermediate transfer belt 16 occurs due to the pushing force of a bias roll. Since the hardness of the transfer surface of the intermediate transfer belt 16 has an influence on deletion of a line image (hollow character), the hardness of the transfer surface may be a surface micro hardness of 30 or less (preferably 25 or less).

The surface micro hardness may be obtained by a method of measuring an amount of entry of an indenter into a sample. When a test load is represented by P (mN), and an entry amount of the indenter into the sample (indentation depth) is represented by D (μm), the surface micro hardness DH is defined by the following Equation (4).

$$DH=\alpha P/D^2 \quad \text{Equation (4)}$$

Here, α is a constant based on the shape of the indenter and α=3.8584 (in the case in which a triangular pyramid indenter is used).

The surface micro hardness of the intermediate transfer belt is obtained by the following method. An intermediate transfer belt is cut into around 5 mm squares, and a small piece is fixed to a glass plate with an instant adhesive. The surface micro hardness of the surface of the sample is measured using an ultra micro hardness tester DUH-201S (manufactured by Shimadzu Corporation).

The measurement conditions are as follows.

Measurement environment: 22° C., 55% RH

Used indenter: triangular indenter

Test mode: 3 (soft material test)

Test load: 0.70 gf

Load speed: 0.0145 gf/sec

Retention time: 5 sec

The intermediate transfer belt may be applied to, for example, an image forming apparatus capable of carrying out high speed printing. The printing speed is determined in consideration of the transport rate of each member used in an image forming apparatus, that is, the transport rate of each member involving transporting a toner image to an image holding member, an intermediate transfer belt, and a recording medium in the apparatus to carry out printing. The intermediate transfer belt may reduce unevenness in density and spot defects even in the case in which the transport rate of each member is 200 mm/sec or more. Even when the transport rate is less than 200 mm/sec, a good image may be formed.

In addition, primary transfer from a photoreceptor to an intermediate transfer belt is an important factor for determining the quality of a final image. Since there is no disturbance in the transfer efficiency of primary transfer and the image at the time of transfer, it is preferable that the transfer current value is high.

In the case in which the transport rate of the intermediate transfer belt is 200 mm/sec or more, the primary transfer current value is preferably 25 μA or more and more preferably 30 μA or more.

The endless belt according to the exemplary embodiment may be used in various types of image forming apparatuses in addition to an image forming apparatus capable of forming a color image, which will be described later, and may be used in an image forming apparatus, for example, an electrophotographic copier, a laser printer, a facsimile, or a composite OA machine of these devices.

Image Forming Apparatus

The image forming apparatus according to the exemplary embodiment has the above endless belt. In the case in which the endless belt is applied to a belt such as an intermediate transfer belt, a transfer belt, and a transport belt (recording medium transport belt), as the image forming apparatus according to the exemplary embodiment, for example, an image forming apparatus shown below may be adopted.

An image forming apparatus including an image holding member, a charging unit that charges a surface of the image holding member, an electrostatic charge image forming unit that forms an electrostatic charge image on a charged surface of the image holding member, a developing unit that forms a toner image by developing the electrostatic charge image formed on the surface of the image holding member with a developer including a toner, and a transfer unit that transfers the toner image to a surface of a recording medium via the endless belt according to the exemplary embodiment may be adopted.

The transfer unit may have the endless belt unit which will be described later.

Specifically, the image forming apparatus according to the exemplary embodiment may have a configuration in which, for example, the transfer unit includes an intermediate transfer member, a primary transfer unit that primarily transfers the toner image formed on the image holding member to the intermediate transfer member, and a secondary transfer unit that secondarily transfers the toner image transferred to the intermediate transfer member to a recording medium, and includes the endless belt according to the exemplary embodiment as the intermediate transfer member.

In addition, the image forming apparatus according to the exemplary embodiment may have a configuration in which, for example, the transfer unit includes a recording medium transport member (recording medium transport belt) for transporting a recording medium, and a transfer unit for transferring the toner image formed on the image holding member to a recording medium transported by the recording medium transport member, and includes the endless belt according to the exemplary embodiment as the recording medium transport member.

Hereinafter, with reference to the drawing, an image forming apparatus according to an exemplary embodiment will be described in detail.

Figure 2:
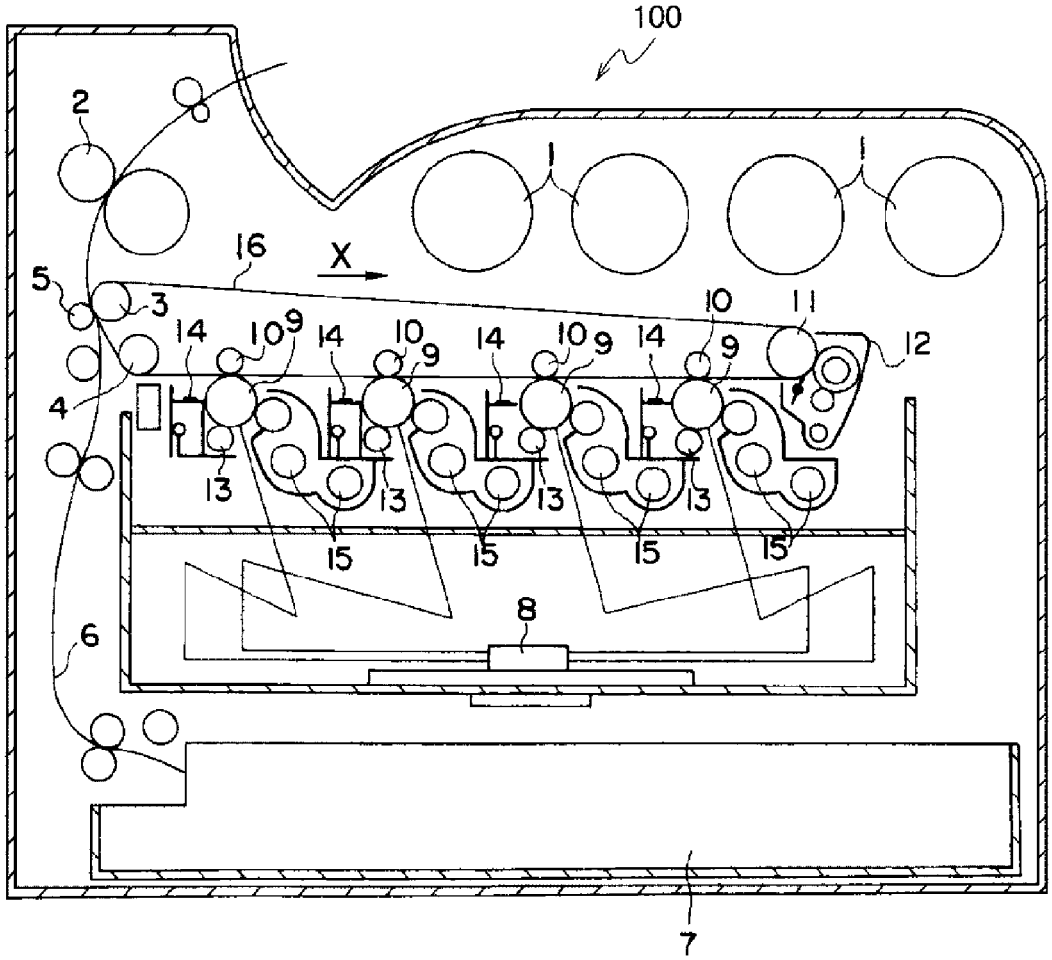
FIG. 2 is a schematic configuration view showing an image forming apparatus according to an exemplary embodiment.

FIG. 2 is a schematic configuration view showing an image forming apparatus 100 to which the endless belt according to the exemplary embodiment is applied. The image forming apparatus 100 shown in FIG. 2 includes, as principal constituent members, four toner cartridges 1, one pair of fixing rolls 2 (an example of a fixing unit), a back-up roll 3 (rear surface roll), a tension roll 4 (stretching roll), a secondary transfer roll 5 (an example of a secondary transfer unit), a paper path 6, a paper tray 7, a laser generating device 8 (an example of an electrostatic charge image forming unit), four photoreceptors 9 (an example of an image holding member), four primary transfer rolls 10 (an example of a primary transfer unit), a driving roll 11, an intermediate transfer member cleaning device 12, four charging rolls 13 (an example of a charging unit), a photoreceptor cleaning device 14, a developer unit 15 (an example of a developing unit), and an indeterminate transfer belt 16 (an example of an intermediate transfer member). In the image forming apparatus 100 shown in FIG. 2, the endless belt according to the exemplary embodiment is used as the intermediate transfer belt 16 which functions as a unit for overlaying toner images, and a unit for transferring a toner image.

Next, the configuration of the image forming apparatus 100 shown in FIG. 2 will be described sequentially. First, the charging roll 13, the developer unit 15, the primary transfer roll 10 disposed via the intermediate transfer belt 16, and the photoreceptor cleaning device 14 are disposed counterclockwisely around the photoreceptor 9, and one set of these members form a developing unit corresponding to one color. In addition, each of these developing units is provided with a toner cartridge 1 for replenishing developer to each developer unit 15 and the laser generating device 8 which may emit laser light to the surface of the photoreceptor 9 between the charging roll 13 and the developer unit 15 according to image information is provided relative to the photoreceptor 9 of each developing unit.

Four developing units corresponding to four colors (for example, cyan, magenta, yellow, and black) are disposed in series in a horizontal direction in the image forming apparatus 100, and the intermediate transfer belt 16 is provided so as to pass through a nip portion between the photoreceptor 9 and the primary transfer roll 10 of each of the four developing units. The intermediate transfer belt 16 is stretched by the back-up roll 3, the tension roll 4, and the driving roll 11 which are provided in this order counterclockwisely on its inner circumferential side. Four primary transfer rolls 10 are positioned between the tension roll 4 and the driving roll 11. The intermediate transfer member cleaning device 12 for cleaning the outer circumferential surface of the intermediate transfer belt 16 is provided so as to contact with the driving roll 11 under pressure on the opposite side of the driving roll 11 via the intermediate transfer belt 16.

In addition, the secondary transfer roll 5 for transferring a toner image that is formed on the outer circumferential surface of the intermediate transfer belt 16 to the surface of a recording sheet that is transported from the paper tray 7 via the paper path 6 is provided so as to contact with the back-up roll 3 under pressure, on an opposite side of the back-up roll 3 via the intermediate transfer belt 16. On the outer circumferential surface of the intermediate transfer belt 16 between the back-up roll 3 and the driving roll 11, an erasing roll (not shown) for erasing the charge on the external circumferential surface is provided.

Further, the paper tray 7 for stocking a recording sheet is provided at the bottom portion of the image forming apparatus 100, and paper may be supplied so as to pass through a pressure-contacting portion between the back-up roll 3 and the secondary transfer roll 5 constituting a secondary transfer portion from the paper tray 7 via the paper path 6. The recording sheet which had passed through the pressure-contacting portion may be transported by a transport unit (not shown) so as to pass through the pressure-contacting part of the pair of fixing rolls 2, and finally may be ejected outside of the image forming apparatus 100.

Next, an image forming method using the image forming apparatus 100 shown in FIG. 2 will be described. A toner image is formed in every developing unit and the surfaces of the photoreceptors 9 rotating counterclockwise are uniformly charged with the charging rolls 13. Then, latent images are formed on the surfaces of the charged photoreceptors 9 by the laser degenerating device 8 (exposure device), and the latent images are then developed with a developer supplied from the developing units 15 to form toner images. The toner images brought to the pressure-contacting portion between the primary transfer rolls 10 and the photoreceptors 9 are transferred to the outer circumferential surface of the intermediate transfer belt 16 rotating in the direction of an arrow X. The toner and refuse adhering to the surfaces of the photoreceptors 9 after transfer of the toner images are cleaned by the photoreceptor cleaners 14, ready for formation of the next toner image.

In a state in which the toner images of each color developed in every developing unit are sequentially superimposed on the outer circumferential surface of the intermediate transfer belt 16 so as to correspond to image information, the toner images are transported to the secondary transfer portion and then transported to the surface of the recording sheet transported from the paper tray 7 via the paper path 6, by the secondary transfer roll 5. The recording sheet to which the toner image has been transferred is further fixed by heating under pressure upon passing through a pressure-contacting portion of the pair of fixing rolls 2 constituting a fixing portion and, after an image is formed on the surface of the recording medium, the recording sheet is discharged outside the image forming device 100.

The intermediate transfer belt 16 which has passed through the secondary transfer portion proceeds further in the direction of the arrow X, the outer circumferential surface thereof is erased by the easing roll (not shown), and then the outer circumferential surface is cleaned with the intermediate transfer member cleaning device 12, ready for transfer of a next toner image.

As the photoreceptor 9 (an example of the image holding member), known photoreceptors may be used. As the photosensitive layer, known photosensitive layers such as those formed from an organic system or those formed from amorphous silicon may be used. From the viewpoint of image stability, photosensitive layer formed from an organic system is preferable. In the case in which the image holding member is cylindrical, the image holding member may be obtained by a known process such as extrusion and molding of aluminum or an aluminum alloy, followed by a surface treatment or the like. In addition, the above-mentioned image holding member having a belt-shaped shape may be used.

The charging roll 13 (an example of the charging unit) is not particularly limited and examples thereof include known chargers such as a contact type chargers using a conductive or semiconductive roller, a brush, a film, a rubber blade or the like, and a scorotron transfer charger and a corotron transfer charger using corona discharge. Among these, from the viewpoint of excellent charge compensating ability, a contact type transfer charger is preferable. The charging unit may apply a direct current to an electrophotography photoreceptor or an alternate current may be applied by overlapping.

The laser generating device 8 (exposure device) (an example of the electrostatic charge image forming unit) is not particularly limited and examples thereof include an optical equipment which may expose the surface of the photoreceptor 9 into a predetermined image shape by using a light source such as semiconductor laser light, LED light or liquid crystal shutter light or via a polygon mirror from these light sources.

The developer unit 15 (an example of the developing unit) may be appropriately selected in accordance with purposes. For example, known developer units for performing developing by contacting a one-component developer or a two-component developer using a brush or a roller, or without contacting the developer may be used.

Examples of the primary transfer roll 10 (an example of the primary transfer unit) include known transfer chargers such as a contact type transfer charger using a belt, a roller, a film, or a rubber blade, and a scorotron transfer charger and a corotron transfer charger using corona discharge. Among these, from the viewpoint of excellent charge compensating ability, a contact type transfer charger is preferable. In addition to the transfer chargers, a peeling charger or the like may be used together.

Examples of the secondary transfer roll 5 (an example of the secondary transfer unit) include a contact type transfer charger, a scorotron transfer charger and a corotron transfer charger. Among these, similar to the primary transfer unit, a contact type transfer charger is preferable. When stronger pushing is applied with a contact type transfer charger such as a transfer roll, the transferred state of an image may be maintained in a good state. When pushing is applied with a contact type transfer charger such as a transfer roll at a position of a roller guiding the intermediate transfer belt 16, it becomes possible to perform an action of transferring a toner image from the intermediate transfer belt 16 to a transfer medium (paper) in a good state.

The fixing roll 2 (an example of the fixing unit) is not particularly limited and for example, a known fixing equipment such as a thermal roller fixing equipment or an oven fixing equipment may be used.

In addition, the cleaning unit is not particularly limited and a known cleaning device may be used.

Further, it is preferable to provide an optical erasing unit. Examples of the optical erasing unit include a tungsten lamp and LED. Examples of light quality used in the optical easing process include white light such as a tungsten lamp, and red light such as LED light. The intensity of the light irradiation in the optical erasing process is usually output-set so as to be around a few to about 30-fold an optical amount showing a half exposure sensitivity of an electrophotography photoreceptor.

Endless Belt Unit

An endless belt unit according to an exemplary embodiment, an endless belt unit including the endless belt according to the exemplary embodiment, and plural rolls over which the endless belt is stretched in a state in which tension is applied may be used.

Figure 3:
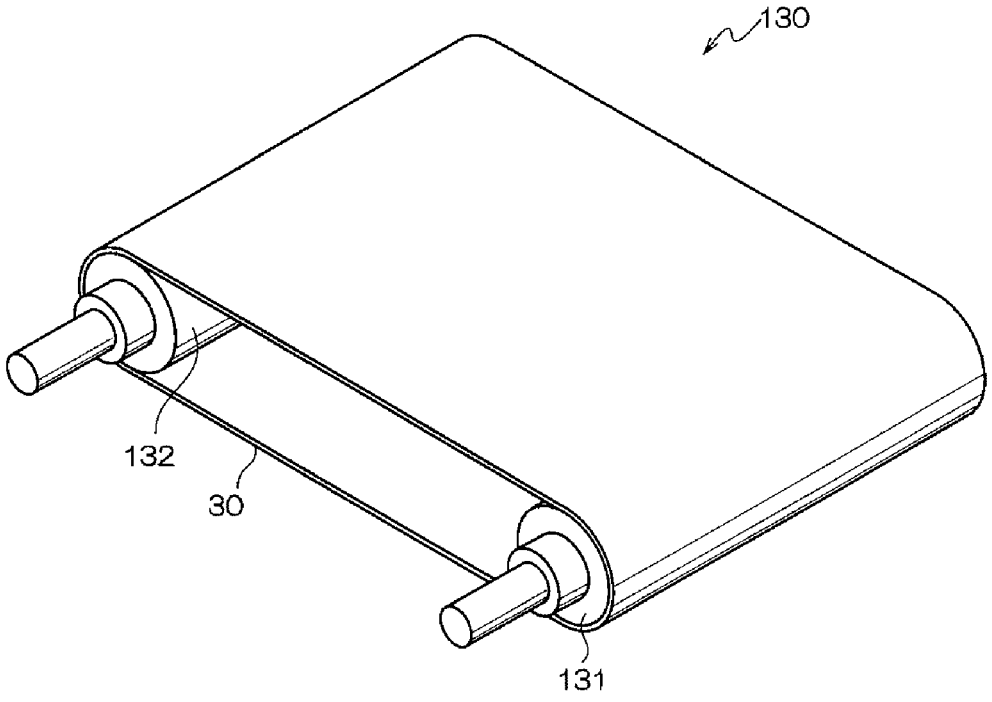
FIG. 3 is a schematic perspective view showing an endless belt unit according to an exemplary embodiment.

For example, as an example of the endless belt unit according to the exemplary embodiment, an endless belt unit shown in FIG. 3 may be used.

FIG. 3 is a schematic perspective view showing an example of an endless belt unit according to an exemplary embodiment.

As shown in FIG. 3, an endless belt unit 130 according to an exemplary embodiment includes the endless belt 30 according to the exemplary embodiment, and for example, the endless belt 30 is stretched in a state in which tension is applied by a driving roll 131 and a driven roll 132 that are disposed to face each other.

Here, in the endless belt unit 130 according to the exemplary embodiment, in the case of applying the endless belt 30 as an intermediate transfer member, as rolls that support the endless belt 30, a roll for primarily transporting a toner image on the surface of a photoreceptor (image holding member) to the endless belt 30, and a roll for further secondarily transporting the toner image which has been transported on the endless belt 30 to a recording medium may be disposed.

The number of rolls that support the endless belt 30 is not limited and the rolls may be disposed according to the purpose of use. The endless belt unit 130 having the above configuration is used in a state in which the endless belt unit is incorporated and is rotated by the rotation of the driving roll 131 and the driven roll 132 in a state in which the endless belt 30 is supported.

EXAMPLES

Hereinafter, examples will be described. However, the invention is not limited to these examples. In the following description, unless otherwise specified, "part(s)" and "%" are based on weight.

Synthesis Example A

Preparation of Polyamide Imide Resin Composition (A-1)

192.13 g (1.0 mol) of trimellitic acid anhydride, 250.25 g (1.0 mol) of 4,4'-diphenylmethane diisocyanate, and 1,420 g of tetramethyl urea are put into a 3-liter four-necked flask and the temperature is raised to 120° C. in a nitrogen stream to conduct a reaction for about 5 hours.

The number average molecular weight of the obtained polyamide imide resin by GPC measurement is 26,000.

Thereafter, the resin is diluted with tetramethyl urea so that the viscosity thereof is adjusted to 20 Pa·s and filtered with a 20 μm mesh made of stainless steel. Then, defoaming is carried out for 12 hours under reduced pressure (0.02 MPa). Thus, a polyamide imide resin composition (A-1) is obtained.

Preparation of Polyamide Imide Resin Compositions (A-2) to (A-9) and (A-1C) to (A-7C)

Polyamide imide resin compositions (A-2) to (A-9) and polyamide imide resin compositions (A-1C) to (A-7C) for Comparative Examples are obtained in the same manner as in the preparation of the polyamide imide resin composition (A-1) except that a solvent to be used is changed solvents shown in Tables 1 and 2. The boiling point mentioned in the column of the boiling point of the solvent group A of the polyamide imide resin compositions (A-1C) to (A-3C) and (A-6C) indicates boiling points of solvents other than the solvent group A.

Example A1

Preparation of Endless Belt (A-1)

A silicone release agent (trade name: KS-700, manufactured by Shin-Etsu Chemical Co., Ltd.) is applied to the outer circumferential surface of a cylindrical metal mold (substrate) made of stainless steel and having an outer diameter of 168 mm and a length of 500 mm, and is subjected to a drying treatment (release agent treatment).

While the cylindrical metal mold which has been subjected to the release agent treatment is being rotated in the circumferential direction, the polyamide imide resin composition (A-1) is applied by a flow coating (spiral coating) method. After the application, the cylindrical metal mold is kept rotating for 2 minutes, thereby performing leveling.

While the coated cylindrical metal mold is being rotated in a drying furnace, a drying treatment is performed at 60° C. for 30 minutes to form a dried film. Then, the film is heated at 250° C. for 60 minutes to form a resin film. Thereafter, the resin film is cooled to room temperature (25° C.) and the resin film is released from the cylindrical metal mold. Thus, an endless belt (A-1) is obtained.

The thickness of the belt is 80 μm.

Examples A2 to A19 and Comparative Examples A1 to A7

Preparation of Endless Belts (A-2) to (A-19) and (A-1C) to (A-7C)

Endless belts (A-2) to (A-19) and endless belts (A-1C) to (A-7C) for Comparative Examples are obtained in the same manner as in Example A1 except that the heating temperature and the heating time (at 250° C. for 60 minutes) of Example A1 are changed to the conditions shown in Tables 1 and 2.

The obtained endless belts (A-1) to (A-19) and (A-1C) to (A-7C) are subjected to the following evaluations.

Measurement of Amount of Residual Solvent

The amount (content) of the residual solvent is measured with GC-MS according to the above-described method.

Storage Stability of Belt

Shafts having a diameter of 5 mm are put into the endless belt and in a state in which the endless belt is suspended by applying a load of 5 kg to one shaft, the endless belt is stored for one week under conditions of a temperature of 60° C. and a humidity of 90%. Then, the endless belt is further stored for one week under conditions of a temperature of 15° C. and a humidity of 20%. Thereafter, a change in shape (deflection) immediate after the shafts and the load are eliminated and after 24 hours has passed from the elimination is measured and the entire surface of the endless belt is observed for evaluation based on the following criteria.

Evaluation Criteria

A+: A change in shape is not observed.

A: A deflection less than 3 mm is observed.

B: A deflection of 3 mm or more and less than 6 mm is observed.

C: A deflection of 6 mm or more is observed.

TABLE 1

| Comparative Example A1 | Comparative Example A2 | Comparative Example A3 | Comparative Example A4 | Comparative Example A5 | Comparative Example A6 | Comparative Example A7 |
|---|---|---|---|---|---|---|

TABLE 1-continued

| | | | | | | | | |
|---|---|---|---|---|---|---|---|---|
| PAI composition No. | | A-1C | A-2C | A-3C | A-4C | A-5C | A-6C | A-7C |
| Solvent used | Solvent group A | — | — | — | DMI | DMI | — | DMI |
| | Boiling point of solvent group A | 204 | 165 | 204 | 225 | 225 | 189 | 225 |
| | Rate (%) in total solvents | — | — | — | 100 | 100 | — | 25 |
| | Other than Solvent group A | NMP | DMAc | GBL | — | — | DMSO | GBL |
| | Rate (%) in total solvents | 100 | 100 | 100 | — | — | 100 | 75 |
| PAI number average molecular weight (ten thousands) | | 2.4 | 2.5 | 2.4 | 2.4 | 2.4 | 2.5 | 2.5 |
| Endless belt | Endless belt No. | A-1C | A-2C | A-3C | A-4C | A-5C | A-6C | A-7C |
| | Heating temperature (° C.) | 250 | 250 | 250 | 270 | 240 | 250 | 270 |
| | Heating time (hr) | 60 | 60 | 60 | 90 | 40 | 60 | 75 |
| | Residual amount of solvent group A in belt (%) | 0.81 | 0.33 | 0.25 | 0.004 | 3.18 | 0.29 | 0.004 |
| Evaluation | Immediately after load elimination | C | C | C | B | B | C | B |
| | After 24 hours from load elimination | B | B | C | B | B | C | B |

| | | | Example A1 | Example A2 | Example A3 | Example A4 | Example A5 | Example A6 | Example A7 |
|---|---|---|---|---|---|---|---|---|---|
| PAI composition No. | | | | A-1 | | A-2 | | A-3 | |
| Solvent used | Solvent group A | | | TMU | | TEU | | B-4 | |
| | Boiling point of solvent group A | | | 177 | | 214 | | 215 | |
| | Rate (%) in total solvents | | | 100 | | 100 | | 100 | |
| | Other than Solvent group A | | | — | | — | | — | |
| | Rate (%) in total solvents | | | — | | — | | — | |
| PAI number average molecular weight (ten thousands) | | | | 2.6 | | 2.5 | | 2.6 | |
| Endless belt | Endless belt No. | | A-1 | A-2 | A-3 | A-4 | A-5 | A-6 | A-7 |
| | Heating temperature (° C.) | | 250 | 260 | 250 | 250 | 260 | 250 | 240 |
| | Heating time (hr) | | 60 | 90 | 40 | 60 | 90 | 60 | 40 |
| | Residual amount of solvent group A in belt (%) | | 0.87 | 0.08 | 1.23 | 0.23 | 0.07 | 0.57 | 1.34 |
| Evaluation | Immediately after load elimination | | A | A | A | A | A | A | A |
| | After 24 hours from load elimination | | A+ | A | A | A+ | A | A+ | A |

TABLE 2

| | | Example A8 | Example A9 | Example A10 | Example A11 | Example A12 | Example A13 | Example A14 | Example A15 | Example A16 | Example A17 | Example A18 | Example A19 |
|---|---|---|---|---|---|---|---|---|---|---|---|---|---|
| PAI composition No. | | A-4 | | | | A-5 | | | | A-6 | A-7 | A-8 | A-9 |
| Solvent used | Solvent group A | B-4 | | | | DMI | | | | DMI | DMPU | B-7 | C-3 |
| | Boiling point of solvent group A | 215 | | | | 225 | | | | 225 | 246 | 252 | 280 |
| | Rate (%) in total solvents | 75 | | | | 100 | | | | 70 | 100 | 100 | 100 |
| | Other than Solvent group A | CRN | | | | — | | | | PGMEA | — | — | — |
| | Rate (%) in total solvents | 25 | | | | — | | | | 30 | — | — | — |
| PAI number average molecular weight (ten thousands) | | 2.6 | | | | 2.7 | | | | 2.7 | 2.6 | 2.5 | 2.6 |
| Endless belt | Endless belt No. | A-8 | A-9 | A-10 | A-11 | A-12 | A-13 | A-14 | A-15 | A-16 | A-17 | A-18 | A-19 |
| | Heating temperature (° C.) | 250 | 270 | 260 | 260 | 250 | 250 | 250 | 240 | 250 | 250 | 250 | 250 |

TABLE 2-continued

| | | Example A8 | Example A9 | Example A10 | Example A11 | Example A12 | Example A13 | Example A14 | Example A15 | Example A16 | Example A17 | Example A18 | Example A19 |
|---|---|---|---|---|---|---|---|---|---|---|---|---|---|
| | Heating time (hr) | 60 | 60 | 60 | 40 | 80 | 60 | 40 | 60 | 60 | 60 | 60 | 60 |
| | Residual amount of solvent group A in belt (%) | 0.36 | 0.01 | 0.07 | 0.12 | 0.58 | 0.89 | 1.37 | 2.26 | 0.75 | 0.86 | 0.92 | 0.97 |
| Evaluation | Immediately after load elimination | A | B | A | A+ | A+ | A+ | A | B | A+ | A | A | A |
| | After 24 hours from load elimination | A+ | A | A+ | A+ | A+ | A+ | A | A | A+ | A+ | A+ | A |

Synthesis Example B

Preparation of Polyamide Imide Resin Composition (B-1)

192.13 g (1.0 mol) of trimellitic acid anhydride, 105.10 g (0.5 mol) of naphthalene-2,6-diisocyanate, 125.16 g (0.5 mol) of 4,4'-diphenylmethane diisocyanate, and 1,340 g of tetramethyl urea are put into a 3-liter four-necked flask and the temperature is raised to 120° C. in a nitrogen stream to conduct a reaction for about 5 hours. Thus, a polyamide imide resin composition (B-1) having a nonvolatile content concentration of 20% by weight is obtained. The number average molecular weight of the obtained polyamide imide resin by GPC measurement is 24,000.

Preparation of Polyamide Imide Resin Compositions (B-2) to (B-9) and (B-1C) to (B-7C)

Polyamide imide resin compositions (B-2) to (B-9) and polyamide imide resin compositions (B-1C) to (B-7C) for Comparative Examples are obtained in the same manner as in the preparation of the polyamide imide resin composition (B-1) except that a solvent to be used is changed to solvents shown in Tables 3 and 4. The boiling point mentioned in the column of the boiling point of the solvent group A of the polyamide imide resin compositions (B-1C) to (B-3C) and (B-6C) indicates boiling points of solvents other than the solvent group A.

Example B1

Preparation of Intermediate Transfer Endless Belt (B-1)

18 parts by weight of dried oxidized carbon black (trade name: SPECAL BLACK 4, manufactured by Orion Engineered Carbons Co., Ltd.), and 18 parts by weight of oxidized carbon black (trade name: SPECAL BLACK 250, manufactured by Orion Engineered Carbons Co., Ltd.), which had been dried in the same manner, are added to 500 parts by weight of the polyamide imide resin composition (B-1) (having a nonvolatile content of 100 parts by weight), and the mixture is subjected to a dispersion treatment (150 MPa, 5 passes) with a wet het mill disperser (Geanus PY, manufactured by Genus Co., Ltd.). Thus, a carbon black dispersed polyamide imide resin composition is obtained. The composition is filtered with a 20 μm mesh made of stainless steel to remove foreign substances and carbon black aggregates. Then, defoaming is carried out under reduced pressure (0.02 MPa) for 12 hours to prepare a final coating liquid.

Using this coating liquid, an endless belt is prepared in the same manner as in Example A1. The endless belt is used as an intermediate transfer endless belt (B-1). The thickness of the belt is 80 μm.

Examples B2 to B26 and Comparative Examples B1 to B7

Preparation of Intermediate Transfer Endless Belts (B-2) to (B-26) and (B-1C) to (B-7C)

Intermediate transfer endless belts (B-2) to (B-26) and intermediate transfer endless belts (B-1C) to (B-7C) for Comparative Examples are obtained in the same manner as in Example B1 except that the heating temperature and the heating time (at 250° C. for 60 minutes) of Example B1 are changed to the conditions shown in Tables 3 and 4.

The obtained intermediate transfer endless belts (B-1) to (B-26) and intermediate transfer endless belts (B-1C) to (B-7C) for comparative Examples are subjected to the following evaluations.

Measurement of Amount of Residual Solvent

According to the above-described method, the amount (content) of the residual solvent is measured by GC-MS.

Image Formation Test

The obtained intermediate transfer endless belt is incorporated into a modified machine of DocuCentre Color 2220, manufactured by Fuji Xerox Co., Ltd. (modified to have a process speed of 250 mm/sec and a primary transfer current of 35 μA) and in a high temperature and high humidity environment (32° C., 85% RH), a black image having a 50% halftone density is formed on 100,000 sheets of C2 paper, manufactured by Fuji Xerox Co., Ltd. Thereafter, the image is formed on 100,000 sheets of paper in a low temperature and low humidity environment (20° C., 30% RH).

Change Rate of Common Logarithm Value of Surface Resistivity of Endless Belt

The common logarithm value of the surface resistivity (log Ω/square) of the intermediate transfer endless belt before and after a printing test starts is measured based on the above-described method under the following conditions according to JIS K6911 (1995). The endless belt is divided into 8 parts in the circumferential direction and 5 parts in the width direction, and measurement is carried out at 40 points in the plane of the endless belt to set an average value of the obtained values as a common logarithm value of surface resistivity.

Used electrode: circular electrode (UR PROBE of HIGHRESTER IP, manufactured by Mitsubishi Chemical Co., Ltd.: an outer diameter ϕ of a cylindrical electrode portion C: 16 mm, an inner diameter ϕ of a ring-shape electrode portion D: 30 mm, and an outer diameter ϕ: 40 mm)

Measurement environment: 22° C./55% RH

Voltage: 100 V

From the following equation, a change rate of the common logarithm value of surface resistivity is calculated and evaluation is carried out based on the following criteria.

Common logarithm value of surface resistivity before printing test: $X_0$ (log Ω/square)

Common logarithm value of surface resistivity after printing test: $X_1$ (log Ω/square))

Equation: Change rate of common logarithm value of surface resistivity (%)=$(|X_0-X_1|/X_0)\times 100$ A+: The change rate is less than 1%.

A: The change rate is 1% or more and less than 3%.

B: The change rate is 3% or more and less than 5%.

C: The change rate is 5% or more.

Evaluation of Endless Belt Damage (Cracking, Defects, and Deflection)

Regarding each intermediate transfer endless belt after the printing test, the damage of the endless belt is evaluated based on the following criteria.

Evaluation Criteria

A+: None of cracking, defects, and deflection are not observed.

A: Cracking and defects are not observed but deflection of less than 3 mm is observed.

B: Cracking is not observed but defects or deflection of 3 mm or more and less than 6 mm is observed.

C: Cracking, defects, or deflection of 6 mm or more is observed.

Image (Blurring of Characters) Evaluation

After the image formation test, an image of a character chart formed in a direction vertical to the travelling direction of paper is output on one sheet of paper in the image forming apparatus in an environment of 20° C. and 50% RH. The area in which the image of character chart is formed is divided into end portions (an area of 50% in total, 25% from each of both ends) and a center portion 50% (the center area excluding both ends) in the belt rotation axis direction and the image (blurring of characters) is evaluated in each area.

Evaluation Criteria

A+: Blurring of characters is not observed at all in the entire range.

A: Blurring of characters is observed in an area of less than 3%.

B: Blurring of characters is observed in an area of 3% or more and less than 20%.

C: Blurring of characters is observed in an area of 20% or more.

TABLE 3

| | | | Comparative Example B1 | Comparative Example B2 | Comparative Example B3 | Comparative Example B4 | Comparative Example B5 | Comparative Example B6 | Comparative Example B7 |
|---|---|---|---|---|---|---|---|---|---|
| PAI composition No. | | | B-1C | B-2C | B-3C | B-4C | B-5C | B-6C | B-7C |
| Solvent used | Solvent group A | | — | — | — | DMI | DMI | — | DMI |
| | Boiling point of solvent group A | | 204 | 165 | 204 | 225 | 225 | 189 | 225 |
| | Rate (%) in total solvents | | — | — | — | 100 | 100 | — | 25 |
| | Other than Solvent group A | | NMP | DMAc | GBL | — | — | DMSO | GBL |
| | Rate (%) in total solvents | | 100 | 100 | 100 | — | — | 100 | 75 |
| PAI number average molecular weight (ten thousands) | | | 2.4 | 2.5 | 2.4 | 2.4 | 2.4 | 2.5 | 2.5 |
| Endless belt | Endless belt No. | | B-1C | B-2C | B-3C | B-4C | B-5C | B-6C | B-7C |
| | Heating temperature (° C.) | | 250 | 250 | 250 | 270 | 240 | 250 | 270 |
| | Heating time (hr) | | 60 | 60 | 60 | 90 | 40 | 60 | 90 |
| | Residual amount of solvent group A in belt (%) | | 0.77 | 0.36 | 0.27 | 0004 | 3.12 | 0.31 | 0.004 |
| Under low temperature and low humidity | Change in common logarithm value of the surface resistivity | | B | C | B | B | B | B | B |
| | Belt damage (cracking, defects, deflection) | | B | B | C | B | B | C | B |
| | Image quality (blurring of characters) | Center portion | B | B | B | A | B | B | A |
| | | End portion | C | C | C | B | B | C | B |
| Under high temperature and high humidity | Change in common logarithm value of the surface resistivity | | B | C | B | A | B | B | A |
| | Belt damage (cracking, defects, deflection) | | C | C | B | B | B | B | B |
| | Image quality (blurring of characters) | Center portion | C | C | C | A | B | C | A |
| | | End portion | C | C | C | B | B | C | B |

| | | | Example B1 | Example B2 | Example B3 | Example B4 | Example B5 | Example B6 | Example B7 | Example B8 | Example B9 |
|---|---|---|---|---|---|---|---|---|---|---|---|
| PAI composition No. | | | B-1 | | | | B-2 | | B-3 | | B-4 |
| Solvent used | Solvent group A | | TMU | | | | TEU | | B-4 | | B-4 |
| | Boiling point of solvent group A | | 177 | | | | 214 | | 215 | | 215 |
| | Rate (%) in total solvents | | 100 | | | | 100 | | 100 | | 75 |
| | Other than Solvent group A | | — | | | | — | | — | | CPN |
| | Rate (%) in total solvents | | — | | | | — | | — | | 25 |
| PAI number average molecular weight (ten thousands) | | | 2.4 | | | | 2.5 | | 2.3 | | 2.4 |
| Endless belt | Endless belt No. | | B-1 | B-2 | B-3 | B-4 | B-5 | B-6 | B-7 | B-8 | B-9 |
| | Heating temperature (° C.) | | 250 | 260 | 250 | 240 | 250 | 260 | 250 | 240 | 250 |
| | Heating time (hr) | | 60 | 90 | 40 | 40 | 60 | 90 | 60 | 40 | 60 |
| | Residual amount of solvent group A in belt (%) | | 0.78 | 0.07 | 1.14 | 2.23 | 0.34 | 0.06 | 0.63 | 1.42 | 0.37 |
| Under low temperature and low humidity | Change in common logarithm value of the surface resistivity | | A | A | A+ | A | A | A | A | A+ | A |
| | Belt damage (cracking, defects, deflection) | | A+ | A+ | A+ | A | A+ | A+ | A+ | A+ | A+ |
| | Image quality (blurring of characters) | Center portion | A+ | A+ | A | A+ | A+ | A+ | A+ | A | A+ |
| | | End portion | A | A | A | A | A | A | A | A | A |
| Under high temperature and high humidity | Change in common logarithm value of the surface resistivity | | A | A | A | A | A | A | A | A | A |
| | Belt damage (cracking, defects, deflection) | | A+ | A | A | A | A+ | A | A+ | A | A+ |

TABLE 3-continued

| | | | | | | | | | | | |
|---|---|---|---|---|---|---|---|---|---|---|---|
| | Image quality (blurring of characters) | Center portion | A+ | A+ | A+ | A+ | A+ | A+ | A+ | A+ | A+ |
| | | End portion | A | A | A | A | A | A | A | A | A |

TABLE 4

| | | | Example B10 | Example B11 | Example B12 | Example B13 | Example B14 | Example B15 | Example B16 | Example B17 | Example B18 | Example B19 | Example B20 |
|---|---|---|---|---|---|---|---|---|---|---|---|---|---|
| PAI composition No. | | | | | | | | B-5 | | | | | |
| Solvent used | Solvent group A | | | | | | | DMI | | | | | |
| | Boiling point of solvent group A | | | | | | | 225 | | | | | |
| | Rate (%) in total solvents | | | | | | | 100 | | | | | |
| | Other than Solvent group A | | | | | | | — | | | | | |
| | Rate (%) in total solvents | | | | | | | — | | | | | |
| PAI number average molecular weight (ten thousands) | | | | | | | | 2.4 | | | | | |
| Endless belt | Endless belt No. | | B-10 | B-11 | B-12 | B-13 | B-14 | B-15 | B-16 | B-17 | B-18 | B-19 | B-20 |
| | Heating temperature (° C.) | | 270 | 260 | 260 | 260 | 250 | 250 | 250 | 250 | 245 | 240 | 240 |
| | Heating time (hr) | | 60 | 60 | 30 | 40 | 80 | 60 | 40 | 30 | 40 | 60 | 50 |
| | Residual amount of solvent group A in belt (%) | | 0.009 | 0.06 | 0.09 | 0.11 | 0.55 | 0.82 | 1.13 | 1.67 | 1.93 | 2.21 | 2.91 |
| Under low temperature and low humidity | Change in common logarithm value of the surface resistivity | | A | A+ | A | A | A+ | A+ | A+ | A | A | A | A |
| | Belt damage (cracking, defects, deflection) | | A+ | A | A+ | A+ | A+ | A | A+ | A+ | A | A+ | A+ |
| | Image quality (blurring of characters) | Center portion | A+ | A+ | A+ | A+ | A+ | A+ | A+ | A+ | A+ | A+ | A+ |
| | | End portion | A | A | A | A+ | A | A+ | A | A | A | A | A |
| Under high temperature and high humidity | Change in common logarithm value of the surface resistivity | | A | A | A | A | A | A | A | A | A | A | A |
| | Belt damage (cracking, defects, deflection) | | A+ | A+ | A | A+ | A | A+ | A | A+ | A+ | A | A |
| | Image quality (blurring of characters) | Center portion | A+ | A+ | A+ | A+ | A+ | A+ | A+ | A+ | A+ | A+ | A+ |
| | | End portion | A | A | A+ | A | A+ | A | A | A | A+ | A | A |

| | | | Example B21 | Example B22 | Example B23 | Example B24 | Example B25 | Example B26 |
|---|---|---|---|---|---|---|---|---|
| PAI composition No. | | | B-6 | B-7 | | B-8 | | B-9 |
| Solvent used | Solvent group A | | DMI | DMPU | | B-7 | | C-3 |
| | Boiling point of solvent group A | | 225 | 246 | | 252 | | 280 |
| | Rate (%) in total solvents | | 70 | 100 | | 100 | | 100 |
| | Other than Solvent group A | | PGMEA | — | | — | | — |
| | Rate (%) in total solvents | | 30 | — | | — | | — |
| PAI number average molecular weight (ten thousands) | | | 2.6 | 2.5 | | 2.4 | | 2.4 |
| Endless belt | Endless belt No. | | B-21 | B-22 | B-23 | B-24 | B-25 | B-26 |
| | Heating temperature (° C.) | | 250 | 250 | 260 | 250 | 250 | 250 |
| | Heating time (hr) | | 60 | 60 | 40 | 60 | 30 | 60 |
| | Residual amount of solvent group A in belt (%) | | 0.74 | 0.81 | 0.08 | 0.93 | 1.45 | 0.98 |
| Under low temperature and low humidity | Change in common logarithm value of the surface resistivity | | A | A | A+ | A+ | A | A+ |
| | Belt damage (cracking, defects, deflection) | | A+ | A+ | A | A | A | A |
| | Image quality (blurring of characters) | Center portion | A+ | A+ | A+ | A+ | A+ | A+ |
| | | End | A | A | A | A+ | A+ | A |

TABLE 4-continued

| | | | | | | | | |
|---|---|---|---|---|---|---|---|---|
| | | portion | | | | | | |
| Under high temperature and high humidity | Change in common logarithm value of the surface resistivity | | A | A | A | A | A | A |
| | Belt damage (cracking, defects, deflection) | | A+ | A+ | A | A | A | A |
| | Image quality (blurring of characters) | Center portion | A+ | A+ | A+ | A+ | A+ | A+ |
| | | End portion | A+ | A | A | A | A | A |

The abbreviations in Tables 1 to 4 are as follows.

PAI: Polyamide imide resin

TMU: Tetramethyl urea

TEU: Tetraethyl urea

DMPU: N,N'-dimethylpropylene urea

DMI: 1,3-dimethyl-2-imidazolidinone

B-4: Exemplified compound B-4 (3-methoxy-N,N-dimethylpropanamide)

B-7: Exemplified compound B-7 (3-n-butoxy-N,N-dimethylpropanamide)

C-3: Exemplified compound C-3 (5-dimethylamino-2-methyl-5-oxo-methylpentanoate)

NMP: N-methylpyrrolidone

DMAc: N,N-dimethylacetamide

GBL: γ-butyrolactone

PGMEA: Propylene glycol methyl ether acetate

CPN: Cyclopentanone

DMSO: Dimethyl sulfoxide

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An endless belt comprising:

a polyamide imide resin layer in which a content of at least one solvent selected from a urea solvent, an alkoxy group-containing amide solvent, and an ester group-containing amide solvent is from 0.005 parts by weight to 3 parts by weight with respect to 100 parts by weight of an entirety of the polyamide imide resin layer.

2. The endless belt according to claim 1, wherein the content of the at least one solvent is from 0.05 parts by weight to 2 parts by weight with respect to 100 parts by weight of an entirety of the polyamide imide resin layer.

3. The endless belt according to claim 2, wherein a boiling point of the at least one solvent is from 100° C. to 350° C.

4. The endless belt according to claim 2, wherein the at least one solvent is selected from tetramethyl urea, tetraethyl urea, 1,3-dimethyl-2-imidazolidinone, N,N'-dimethylpropylene urea, 3-methoxy-N,N-dimethylpropanamide, and 3-n-butoxy-N,N-dimethylpropanamide.

5. The endless belt according to claim 4, wherein the at least one solvent is 1,3-dimethyl-2-imidazolidinone.

6. The endless belt according to claim 2, wherein the polyamide imide resin layer further comprises conductive particles.

7. The endless belt according to claim 1, wherein the content of the at least one solvent is from 0.1 parts by weight to 1 part by weight with respect to 100 parts by weight of an entirety of the polyamide imide resin layer.

8. The endless belt according to claim 7, wherein a boiling point of the at least one solvent is from 100° C. to 350° C.

9. The endless belt according to claim 7, wherein the at least one solvent is selected from tetramethyl urea, tetraethyl urea, 1,3-dimethyl-2-imidazolidinone, N,N'-dimethylpropylene urea, 3-methoxy-N,N-dimethylpropanamide, and 3-n-butoxy-N,N-dimethylpropanamide.

10. The endless belt according to claim 9, wherein the at least one solvent is 1,3-dimethyl-2-imidazolidinone.

11. The endless belt according to claim 7, wherein the polyamide imide resin layer further comprises conductive particles.

12. The endless belt according to claim 1, wherein a boiling point of the at least one solvent is from 100° C. to 350° C.

13. The endless belt according to claim 12, wherein the polyamide imide resin layer further comprises conductive particles.

14. The endless belt according to claim 1, wherein the at least one solvent is selected from tetramethyl urea, tetraethyl urea, 1,3-dimethyl-2-imidazolidinone, N,N'-dimethylpropylene urea, 3-methoxy-N,N-dimethylpropanamide, and 3-n-butoxy-N,N-dimethylpropanamide.

15. The endless belt according to claim 14, wherein the at least one solvent is 1,3-dimethyl-2-imidazolidinone.

16. The endless belt according to claim 15 wherein the polyamide imide resin layer further comprises conductive particles.

17. The endless belt according to claim 14, wherein the polyamide imide resin layer further comprises conductive particles.

18. The endless belt according to claim 1, wherein the polyamide imide resin layer further comprises conductive particles.

19. An image forming apparatus comprising:

the endless belt according to claim 1.

20. An endless belt unit comprising:

the endless belt according to claim 1; and a plurality of rolls which the endless belt is stretched over in a state where tension is applied.

* * * * *